United States Patent [19]

Hakata et al.

[11] 4,170,981

[45] Oct. 16, 1979

[54] BURNER OF AIR ADJUSTMENT TYPE PROVIDED WITH ANNULAR AIR PASSAGE

[75] Inventors: Yoshihisa Hakata; Masahiro Nakazawa, both of Matsudo, Japan

[73] Assignee: Sky Bussan Kabushiki Kaisha, Kanagawa, Japan

[21] Appl. No.: 777,215

[22] Filed: Mar. 14, 1977

[30] Foreign Application Priority Data

| | | | |
|---|---|---|---|
| Apr. 2, 1976 | [JP] | Japan | 51-36111 |
| Apr. 2, 1976 | [JP] | Japan | 51-36112 |
| Apr. 2, 1976 | [JP] | Japan | 51-36113 |
| Jul. 29, 1976 | [JP] | Japan | 51-90717 |

[51] Int. Cl.[2] ..... F24C 5/02

[52] U.S. Cl. ..... 126/43; 126/38; 126/44

[58] Field of Search ..... 126/38, 44, 43; 431/344

[56] References Cited

U.S. PATENT DOCUMENTS

| | | | |
|---|---|---|---|
| 1,879,954 | 9/1932 | Smith | 126/43 |
| 3,229,679 | 1/1966 | Boij et al. | 126/43 X |
| 3,807,381 | 4/1974 | Fihnstrand | 126/43 |

FOREIGN PATENT DOCUMENTS

| | | | |
|---|---|---|---|
| 101569 | 10/1916 | United Kingdom | 126/43 |

*Primary Examiner*—Edward G. Favors

*Attorney, Agent, or Firm*—Wenderoth, Lind & Ponack

[57] ABSTRACT

A burner of the air adjustment type using a liquid fuel includes a fuel chamber including a bottom wall, a peripheral side wall and at least one fuel gas opening on the top surface portion of the fuel chamber and a burner proper including a fuel chamber attachment, an inner gas chamber and a plurality of final gas openings arranged and distributed annularly on the ceiling wall of the gas chamber. The burner proper further includes variable air openings connected to the gas chamber, wherein an annular variable air passage surrounding the fuel chamber and being connected to the variable air openings at a position lower than the position of the fuel gas opening is formed between the inner face of the peripheral side wall of the gas chamber of the burner proper and the outer face of the peripheral side wall of the fuel chamber. The fuel gas opening, the final gas openings and the annular variable air passage are arranged in such a positional relationship that when the variable air openings are opened, a variable combustion layer is formed in the gas chamber between a fuel gas stream extended from the fuel gas opening to the final gas openings and a variable air stream on the periphery of a fuel gas stream connected to the variable air openings.

25 Claims, 21 Drawing Figures

Fig. 4-A
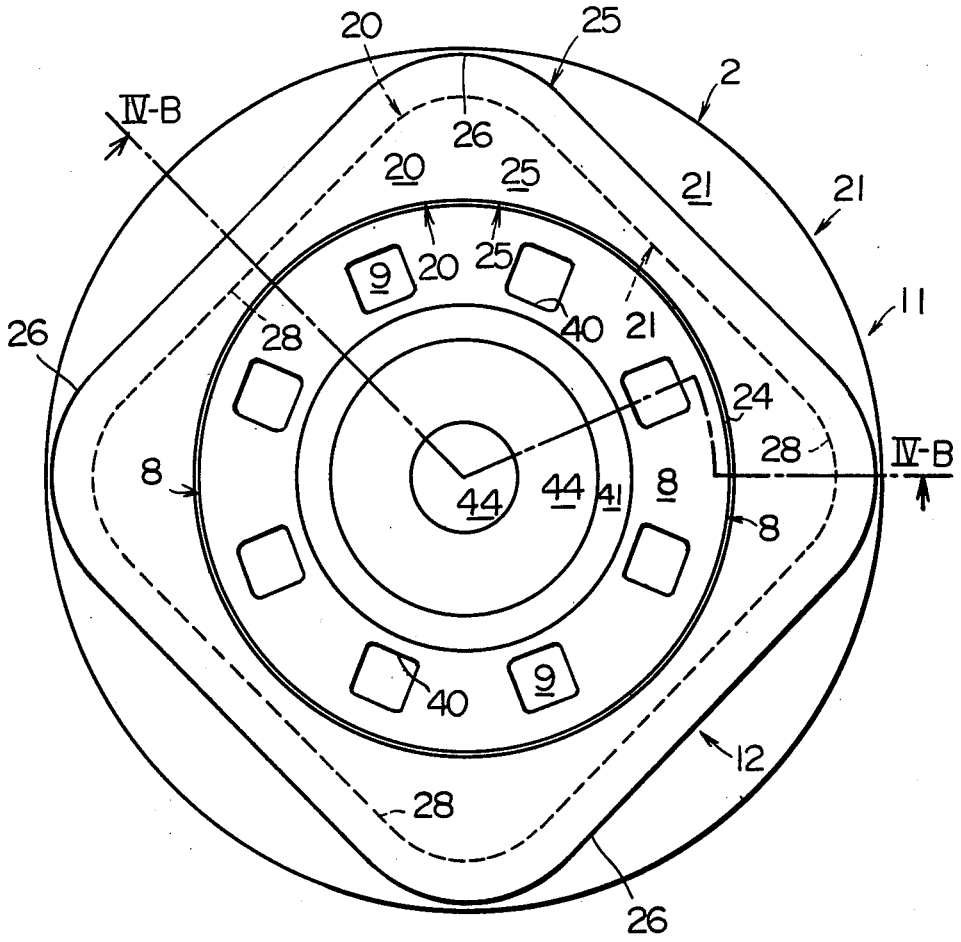

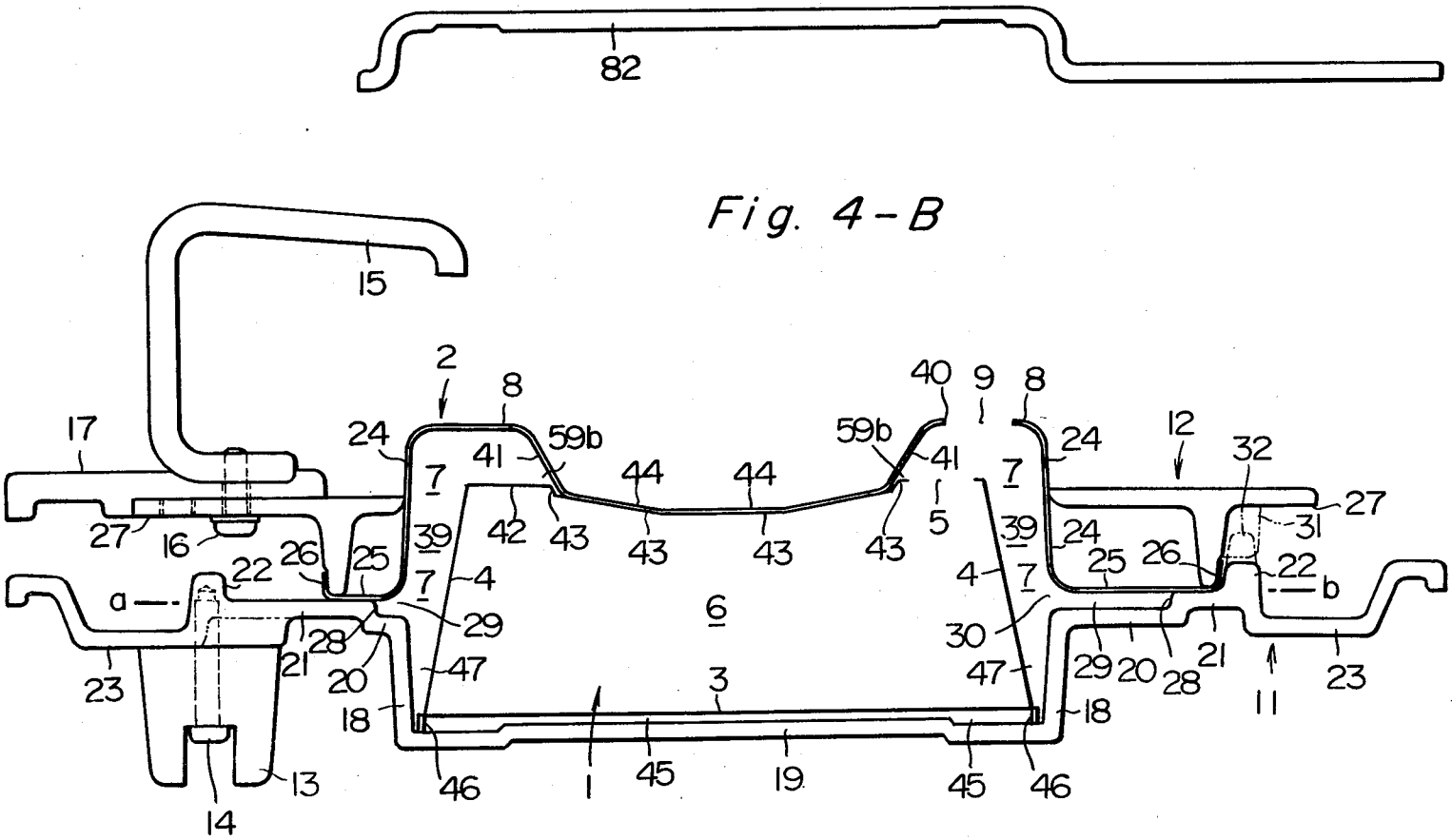
Fig. 4-B

BURNER OF AIR ADJUSTMENT TYPE PROVIDED WITH ANNULAR AIR PASSAGE

BACKGROUND OF THE INVENTION (1) Field of the Invention:

The present invention relates to a burner of the air adjustment type using a liquid fuel such as methyl alcohol. More particularly, the invention relates to a burner of the air adjustment type in which by changing the amount of air flown into the burner, the heating power can be adjusted in a broad range promptly by many stages, undulation or intermission of flames can be effectively prevented in any stage of the heating power adjustment, the maximum heating power can be uniformalized throughout the burning operation, namely at ignition, during normal combustion and just before exhaustion of the fuel, and incomplete combustion can be effectively prevented in any stage of the burning operation.

In the instant specification and claims, by the term "burner of the air adjustment type" is meant an apparatus in which a substance which is liquid in the normal state but generates a combustible gas at room temperature or under heating is used as a fuel, the heating power generated by gas phase combustion of the combustible gas is adjusted by changing the amount of air fed into the apparatus and the so adjusted heating power is utilized for cooking or the like.

(2) Description of the Prior Art

Burners charged with gaseous, liquid or solid fuels, such as so-called portable ranges, have heretofore been used broadly for outdoor cooking, table cooking and the like. For example, ranges installed with a bomb filled with a liquefied natural gas, a liquefied petroleum gas or the like are used for table cooking and the like, and a heating power necessary and sufficient for table cooking can be supplied by ranges of this type and the heating power can be adjusted smoothly in a broad region. However, ranges of this type have various defects and disadvantages. For example, when the heating power is adjusted to a very low level, flames are often extinguished or during cooking flames are blown off, inviting a risk of explosion or poisoning. Further, since high pressure bombs are used, the fuel cost is increased in ranges of this type, and care must be paid to preservation or discarding of such bombs.

On the other hand, ranges using an alcohol such as methyl alcohol as a fuel are advantageous because blow-off of flames is not caused and they can be used in safety. However, a maximum heating power is very low and hence, they are applicable only to preservation of heat in cooked foods or to cooking of foods having a very small heat capacity. Moreover, the difference between adjustable maximum and minimum heating powers is very small and fine adjustment of the heating power adjustment is very difficult.

A most popular known alcohol range comprises a fuel tank, a gas chamber connected to the upper portion of the fuel tank and a sole combustion gas opening formed on the upper portion of the gas chamber. In this alcohol range, only a flame consisting of a sole solid stream is formed and hence, the heating power is very low. Further, diffusion or dispersion of air in this sole solid stream is very difficult and incomplete combustion is readily caused to occur. Moreover, only a part of a pan bottom is selectively heated and uniform heating is impossible, and adjustment of the heating power is difficult. As a modification of this alcohol range, there is known an alcohol range in which a plurality of variable air openings are formed on the side wall of the gas chamber and the heating power can be adjusted by controlling the degree of opening in these air openings. More specifically, in the range of this type, a primary combustion layer is formed in the boundary between a stream of air flown into the gas chamber from the air openings and a combustible gas filled in the gas chamber, formation of the combustible gas by gasification of the liquid fuel is promoted by transfer of the heat from this combustion layer to the fuel in the fuel tank, and the heating power is adjusted by adjusting the amount of heat in the primary combustion layer by opening or closing the air openings. In this burner of the air adjusting type generating a sole solid stream, as the pressure of the combustible gas filled in the gas chamber becomes high, the amount of air flown into the gas chamber is decreased and it becomes difficult to maintain a sufficient amount of heat in the primary combustion layer. Thus, it is difficult to maintain a sufficient maximum heating power and adjust the heating power in a broad region by many stages. Moreover, the above-mentioned defects inherent in the alcohol range of the sole solid stream type cannot be sufficiently overcome. Still further, in the known burner of the air adjustment type, when completely closed air openings are opened or when the air openings are kept in the slightly opened state, undulation, disturbance or intermission of flames can hardly be prevented, and it is very difficult to obtain a sufficiently high maximum heating power and adjust the heating power through a broad range by many stages. More specifically, in the known burner of the air adjustment type, it is very difficult to obtain a sufficiently high maximum heating power, adjust the heating power through a broad range by many stages and prevent incomplete combustion sufficiently while forming a stable primary combustion layer even at the time of opening the completely closed air openings or in the state where the air openings are slightly opened. As a result, prevention of undulation or intermission of the flame by intermissive primary combustion cannot be attained simultaneously with enhancement of the maximum heating power, multi-staged adjustment of the heating power through a broad range or prevention of incomplete combustion.

As another type of the alcohol range, there is known a burner in which the heating power is adjusted by changing an open area of an annularly disposed core member by the vertical movement of the core member or a covering member. In this burner, however, since the core member or cover member is disposed at a position very close to a high temperature combustion zone, the core member or cover member is excessively heated, and even if the open area of the core member is decreased, generation of the combustible gas is kept vigorous and it is ordinarily difficult to lower the heating power and is often difficult to extinguish the flame. Further, even if the combustible gas forms an annular stream in the opening portion of the core member, by the pressure of air from the peripheral portion of the annular stream a formed flame is caused to take a form of the sole solid stream unless a complicated structure including a central hollow portion thrusting through the entire structure in the vertical direction is adopted. Therefore, incomplete combustion of the combustible gas is readily caused in the interior of the flame. Still further, since the cover member falls in sliding contact with the soft liquid-absorbing core member in the area very close to the high temperature combustion zone, the core member is readily damaged and troubles are brought about by damage to the core member.

As will be apparent from the foregoing illustration, in conventional burners using a fuel which is liquid in the normal state and generates a combustible gas at room temperature or under heating, such as methyl alcohol, there is not known a structure in which the heating power can be promptly adjusted through a broad range in many stages or a structure in which a maximum heating power is uniformly maintained at a level sufficiently applicable to ordinary cooking throughout the burning operation, namely at ignition, during normal combustion and just before exhaustion of the fuel, incomplete combustion can be effectively prevented in any stage of the burning operation and undulation or intermission of flames can be effectively prevented in any heating power adjustment stage.

SUMMARY OF THE INVENTION

Methyl alcohol can easily be synthesized from various raw materials such as natural gas, petroleum, solid carbon, petroleum pitch and the like, and it is liquid in the normal state and is completely burnt at relatively low temperatures. Further, by combustion, methyl alcohol is converted to an odorless gas consisting solely of $H_2O$ and $CO_2$. In view of easy availability, easiness in handling, prevention of environmental pollution and low manufacturing cost, methyl alcohol is apparently one of the promising fuels. Therefore, it is desirable to develop a burner such as a range in which methyl alcohol is used as a fuel and the foregoing defects involved in the conventional alcohol ranges are overcome or moderated.

It is therefore a primary object of the present invention to provide a burner of the air adjustment type using a liquid fuel, especially methyl alcohol, in which by simple means of changing the amount of air flown into the burner, multi-staged adjustment of the heating power in a broad region can be accomplished.

Another object of the present invention is to provide a burner of the air adjustment type in which the maximum heating power is uniformly maintained at a level sufficiently applicable to ordinary cooking and the like throughout the burning operation, namely at ignition, during normal combustion and just before exhaustion of the fuel and incomplete combustion is effectively prevented in any stage of the burning operation.

Still another object of the present invention is to provide a burner of the air adjustment type in which the heating power can be adjusted promptly and precisely in follow-up of the change of the amount of supplied air, namely the time lag in the adjustment of the heating power is remarkably shortened.

A further object of the present invention is to provide a burner of the air adjustment type in which occurrence of undulation or intermission of flames caused in the above-mentioned conventional burners of the air adjustment type, namely occurrence of a phenomenon that flames are disturbed and rendered unstable when completely closed air openings are opened or the air openings are kept in the slightly opened state, can be effectively prevented.

A still further object of the present invention is to provide a burner of the air adjustment type using a liquid fuel such as methyl alcohol, in which the structure is relatively simple and the foregoing defects involved in the conventional burners are eliminated.

In accordance with the first aspect of the present invention, there is provided a burner of the air adjustment type using a liquid fuel, which comprises a fuel chamber including a bottom wall, a peripheral side wall and at least one fuel gas opening on the top surface portion of the fuel chamber and a burner proper including a fuel chamber attachment, an inner gas chamber and a plurality of final gas openings arranged and distributed annularly on the ceiling wall of the gas chamber, the burner proper further including variable air openings connected to the gas chamber, wherein an annular variable air passage surrounding the fuel chamber and being connected to the variable air openings at a position lower than the position of the fuel gas opening is formed between the inner face of the peripheral side wall of the gas chamber of the burner proper and the outer face of the peripheral side wall of the fuel chamber, and wherein the fuel gas opening, the final gas openings and the annular variable air passage are arranged in such a positional relationship that when the variable air openings are opened, a variable combustion layer is formed in the gas chamber between a fuel gas stream extended from the fuel gas opening to the final gas openings and a variable air stream on the periphery of a fuel gas stream connected to the variable air openings.

In accordance with a second aspect of the present invention, there is provided a burner as set forth in the first aspect wherein a cylindrical or tapered central inner wall is formed between the vicinity of the inner end edges of the final gas openings on the ceiling wall of the gas chamber and the fuel gas opening or the vicinity thereof, and the innermost face of the gas chamber is defined by the cylindrical or tapered central inner wall.

In accordance with a third aspect of the present invention, there is provided a burner as set forth in the second aspect wherein the fuel chamber has a plurality of fuel gas openings arranged and distributed annularly in the outer edge portion of the ceiling wall of the fuel chamber, and the cylindrical or tapered central inner wall and the ceiling wall of the fuel chamber are disposed so that heat can be transferred between the cylindrical or tapered central inner wall and the ceiling wall of the fuel chamber through the central portion of the ceiling wall of the fuel chamber, which central portion is surrounded by the annularly arranged and distributed fuel gas openings.

BRIEF DESCRIPTION OF THE DRAWINGS

The accompanying drawings illustrate embodiments of the present invention, in which:

FIG. 4-A is a top view of the main part of the burner of FIG. 1 which is in the state that variable air openings are completely closed;

FIG. 4-B is a section taken along the line IVB—IVB in FIG. 4-A, which illustrates the burner with other accessory members;

DETAILED DESCRIPTION OF THE PREFERRED EMBODIMENTS

Figure 1:
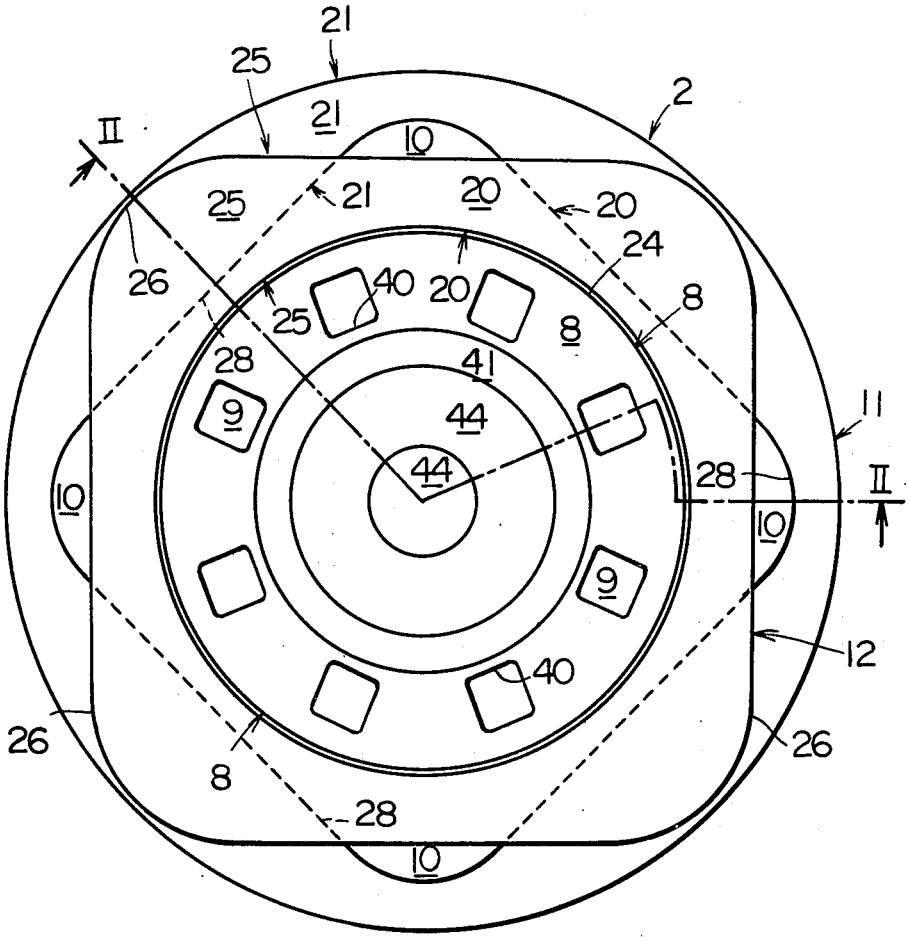
FIG. 1 is a top view illustrating the main part of the burner of the present invention in a simple manner.
Figure 2:
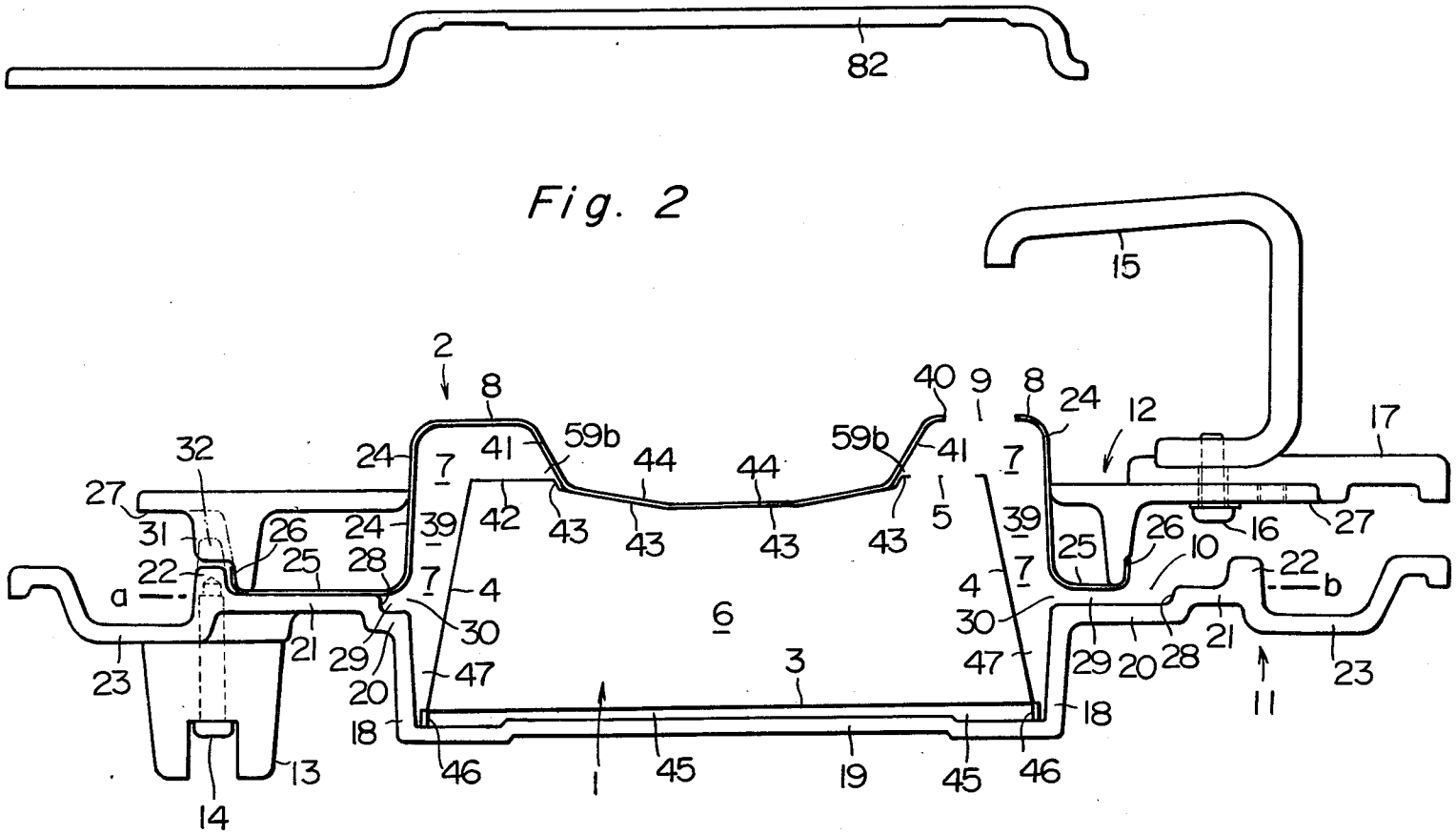
FIG. 2 is a section taken along the line II—II in FIG. 1, which illustrates the burner of the present invention with other accessory members.

Referring to FIGS. 1 and 2 illustrating one embodiment of the burner of the present invention, the burner comprises a fuel chamber 1 and a burner proper 2. The fuel chamber 1 includes a bottom wall 3, a peripheral side wall 4 and fuel gas openings 5 formed on the top surface portion of the fuel chamber, and liquid fuel (not shown) such as methyl alcohol is contained in a space 6 surrounded by the walls 3 and 4. The burner proper 2 includes in the interior thereof a fuel chamber attachment (a portion containing the fuel chamber 1 in the embodiment shown in FIGS. 1 and 2) and an inner gas chamber 7, and a plurality of final gas openings 9 are arranged annularly at intervals on a ceiling wall 8 of the gas chamber 7. The burner proper 2 also has variable air openings 10 connected to the inner gas chamber 7.

This burner proper 2 consists of a lower member 11 supporting the fuel chamber 1 and an upper member 12 having the ceiling wall 8 of the gas chamber. The lower member 11 and upper member 12 are disposed so that they are dismountable and separable from each other along a horizontal sliding face (a-b in FIG. 2). A plurality of legs 13 composed preferably of an elastic material such as rubber are fixed to the lower part of the peripheral edge portion of the lower member 11 by means of a simple clamping member 14 such as a bolt as shown in FIG. 2 (only one leg 13 is shown in FIG. 2 for simplification), so that the lower member 11 is stably supported on a table or the like by these legs 13. A plurality of supporting pieces 15 such as trivets are clamped and fixed, optionally with holding pieces 17 composed of a heat-insulating material, to the upper peripheral portion of the upper member 12 by means of a clamping member 16 such as a bolt so that a cooking vessel such as a pan is held at a position appropriately spaced from the final gas openings 9.

A lower bottom wall 19 concaved downwardly and corresponding to the above-mentioned space for containing the fuel chamber 1 is formed on the lower member 11 through a cylindrical or tapered lower peripheral side wall 18 of the gas chamber, and a concave portion 20 indented below the horizontal sliding face a-b is formed on the periphery of the top edge of the lower peripheral side wall 18 of the gas chamber. A circular plane portion 21 having a top face corresponding to the horizontal sliding face a-b is formed on the outer circumference of the concave portion 20 at a part corresponding to the horizontal sliding face a-b. A circumferential step wall portion 22 projected above the horizontal sliding face a-b is formed on the outer circumference of the circular plane portion 21 and an overflowing food receiver 23 is formed on the outer circumference of the circumferential step wall portion 22.

The upper member 12 comprises a ceiling wall 8 of the gas chamber, a cylindrical or tapered upper peripheral side wall 24 of the gas chamber which is integrated with the ceiling wall 8, a projected plane portion 25 connected to the lower end edge of the upper peripheral side wall 24 and having a lower face corresponding to the horizontal sliding face a-b and an outer end side face portion 26 to be engaged with the inner side of the circumferential step wall portion 22 of the lower member 11, a flange portion 27 rising through the outer end side face portion 26 and extending in the peripheral direction, and a handling piece 17 clamped and fixed, together with a supporting piece 15 such as a trivet, to the flange portion 27 by means of a clamping member 16 such as a bolt.

In the burner proper 2 having the above structure, the upper member 12 and lower member 11 are dismountable and separable from each other, so that the fuel chamber 1 can be separated from the burner proper 2 or a fuel can easily be charged into the fuel chamber 1 then it is of the fixed type. The position of the upper member 12 of the burner proper 2 can easily be set by engaging the outer end side face portion 26 of the projected plane portion 25 of the upper member 12 with the inner side of the circumferential step wall portion 22 of the lower member 11 and supporting the lower face of the projected plane portion 25 of the upper member 12 by the top face of the circular plane portion 21 of the lower member 11.

In FIGS. 1 and 2, an outer contour 28 of the concave portion 20 of the lower member 11 which corresponds to the horizontal sliding face a-b has a non-circular shape, while an outer contour 26 of the projected plane portion 25 of the upper member 12 has a non-circular shape similar to the non-circular shape of the outer contour 28 of the concave portion 20 but slightly larger in the size than the non-circular shape of the outer contour 28 of the concave portion 20. In the embodiment shown in FIG. 1, both the outer contour 28 of the concave portion 20 and the outer contour 26 of the projected plane portion 25 have a square shape, but they may have an optional shape, for example, a triangular, pentagonal or other polygonal shape or a cycoloidal or elliptical shape. Thus, when the upper member 12 is placed on the lower member 11, the projected plane portion 25 of the upper member 12 is secured and supported stably at any phase by the circular plane portion 21 formed on the periphery of the concave portion 20. Respective projected corners of the outer end side face portion 26 of the projected plane portion 25 are always engaged with the inner side of the circumferential step wall portion 22 located on the periphery of the circular plane portion 21 of the lower member 11, so that the upper member 12 and lower member 11 can slide and rotate smoothly with respect to each other on the horizontal sliding face a-b.

Figure 3:
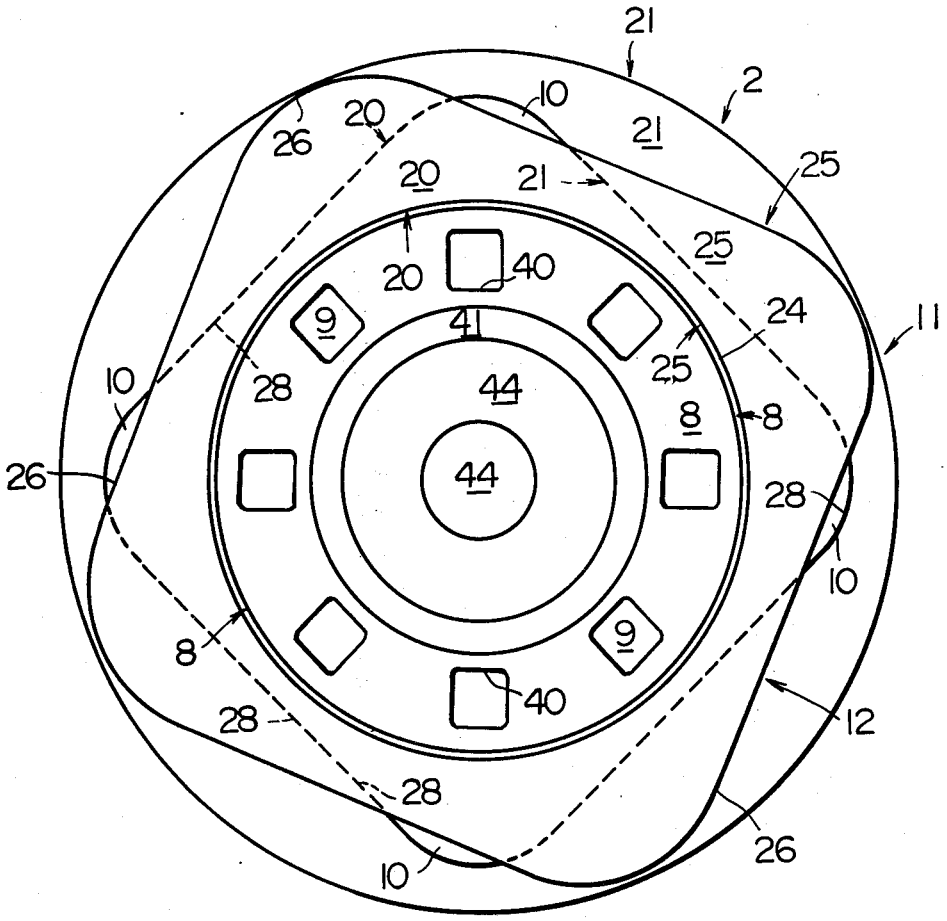
FIG. 3 is a top view of the main part of the burner of FIG. 1 which is in the state that variable air openings are closed so that the open area thereof is considerably narrow.

Variable air openings 10 are formed between the lower member 11 and upper member 12 so that their open areas are changed by the relative rotation of both the members 11 and 12. Namely, openings 10 defined and surrounded by the outer end 26 of the upper member 12 and the outer contour 28 of the lower member 11 located outwardly of the outer end 26 constitute air openings. When the upper member 12 and lower member 11 of the burner proper 2 are rotated relatively to each other through the horizontal sliding plane a-b, the open area of the air openings 10 can be freely changed from the state shown in FIGS. 1 and 2 where the open area of the air openings 10 is largest to the state shown in FIGS. 4-A and 4-B where the air openings 10 are completely closed through the state shown in FIG. 3 where the open area of the air openings 10 is considerably reduced. As shown in FIG. 2, a connection passage 29 formed between the lower face of the non-circular projected plane portion 25 of the upper member 12 and the non-circular concave portion 20 of the lower member 11 is communicated at the outer end portion with the air openings 10 and at the inner end portion with an annular opening 30 to the periphery of the gas chamber 7. The holding piece 17 of the upper member 12 is useful for separating the upper member 12 from the lower member 11 and for rotating the upper member 12 while the burner is being used. Outwardly projected projections 31 are formed above the corners of the outer end side face 26 of the upper member 12 and stoppers 32 are formed above the circumferential step wall portion 22 of the lower member 11, so that when the upper member 12 is turned counterclockwise, the projection 31 impinges against one stopper 32 to stop the rotation of the upper member 12 at a position where the variable air openings 10 are most opened (see FIGS. 1 and 2) and when the upper member 12 is turned clockwise, the projection 31 impinges against the other stopper 32 to stop the rotation of the upper member 12 at a position where the air openings 10 are completely closed (see FIGS. 4-A and 4-B). In the embodiment shown in FIG. 2, the supporting piece 15 such as a trivet is clamped and fixed to the upper member 12. However, it is possible to adopt an arrangement in which an independent supporting piece 15 separated from the upper member 12 is mounted on the lower member 11 or the upper member 12 in the stable state so that it can be freely dismounted or bent.

Another embodiment of the burner of the present invention will now be described by reference to FIG. 5.

A lower member 11*a* and an upper member 12*a* are disposed so that they can be dismounted and separated from each other along a dividing face e-f. An outer wall member 34 having a cylindrical or tapered outside wall 33 capable of sliding relatively to a cylindrical or tapered lower peripheral side wall 18*a* of the gas chamber or cylindrical or tapered upper peripheral side wall 24*a* of the gas chamber is formed on the lower member 11*a* or the upper member 12*a*. In this embodiment, variable air openings 10*a* are formed by rotating this outer wall member 34 by a holding piece 17*a* and thus changing areas of overlaps between openings formed on the cylindrical or tapered outer side wall 33 of the outer wall member 34 and openings formed on the cylindrical or tapered lower peripheral side wall 18*a* or upper peripheral side wall 24*a* of the gas chamber. In the embodiment shown in FIG. 5, the outer wall member 34 is integrated at a part 35 with the holding piece 17*a* by welding or the like, and they are pivoted rotatably to the central portion of a bottom wall 19*a* of the lower member 11*a* as indicated by reference numeral 36. Further, by an arcuate hole 37 formed on the outer wall member 34 and a projecting stopper 38 fixed to the bottom wall 19*a* piercing through arcuate hole 37, the rotation range of the outer wall member 34 is limited between a position where the variable air openings 10*a* are most opened and a position where the variable air openings 10*a* are completely closed.

The operation principle of the burner of the present invention will now be described by reference to FIG. 6.

The burner of the present invention is characterized in that (i) in annular variable air passage 39 connected to air openings 10 and surrounding the fuel chamber 1 is first formed at a position lower than the position of the fuel gas opening 5 between the inner faces of the peripheral side walls 18 and 24 of the gas chamber of the burner proper 2 and the outer face of the peripheral side wall 4 of the fuel chamber 1; (ii) the fuel gas openings 5, the final gas openings 9 and the annular variable air passage 39 are disposed in such a positional relationship that when the air openings 10 are opened, in the gas chamber 7 a variable combustion layer C is formed between a fuel gas stream A extended from the fuel gas openings 5 to the final gas openings 9 and a variable air stream B connected to the air openings 10 and present around the fuel gas stream A; (iii) preferably, a cylindrical or tapered central inner wall 41 is formed between the vicinity of the inner end edge 40 of the final gas openings 9 on the ceiling wall 8 of the gas chamber of the burner proper 2 and the fuel gas openings 5 or the vicinity thereof, and the innermost face of the gas chamber 7, namely the innermost face of the fuel gas stream A, is defined by this cylindrical or tapered central inner wall 41; and (iv) preferably, in the fuel chamber 1, a plurality of annularly arranged and distributed fuel gas openings 5 (see FIG. 7) are formed on the outer edge portion of the ceiling wall 42 of the fuel chamber 1, and central inner wall 41 and ceiling wall 42 are disposed so that heat can be transferred between the central inner wall 41 and the ceiling wall 42 through a central portion 43 of the ceiling wall 42 of the fuel chamber which is surrounded by the fuel gas openings 5.

In order to promote complete combustion, enhance the heating power, increase the efficiency of heating a pan bottom and attain a uniform heating effect, it is important that a plurality of final gas openings 9 are formed so that a flame E consisting of a plurality of annularly distributed solid streams is generated in a final combustion space D. According to experiments made by us, it was confirmed that when a plurality of final gas openings are annularly arranged and distributed in a known alcohol range, incomplete combustion takes place at the time of ignition, the maximum heating power is still insufficient, and the multi-staged heating power adjustment capacity is extremely poor and the adjustment range is very narrow. According to the present invention, by adoption of the above-mentioned specific arrangement, all of these defects can be effectively eliminated.

In the burner of the present invention, the liquid fuel is gasified in the inner space 6 of the fuel chamber 1 and the fuel gas A flown into the gas chamber 7 is discharged as a rising stream to the final combustion space D through the final gas openings 9 and is burnt in the form of a flame E consisting of a plurality of annularly distributed solid streams in the final combustion space D.

In the burner of the present invention, between the inner faces of the peripheral side walls 18 and 24 of the gas chamber and the outer face of the peripheral side wall 4 of the fuel chamber 1 there is formed an annular space 39 which forms a variable air passage when the air openings 10 are opened, and this air passage 39 is communicated with the air openings 10 at an opening portion 30 formed at a position lower than the position of the fuel gas opening 5. By adoption of this arrangement, air introduced into the burner through the air openings 10 is entirely converted to a rising stream in the annular space 39, and this rising stream B of air becomes a strong rising stream uniformly annulated in the horizontal direction when it arrives at a point very close to the top end of the peripheral side wall 4 of the fuel chamber.

In the gas chamber 7, primary combustion is carried out in the boundary between the fuel gas stream A and the variable air stream B rising in the state surrounding the periphery of the fuel gas stream A, whereby a variable combustion layer C is formed. Since the air stream B is a very strong rising stream uniformly annulated at this point, there can be attained the following effects; (1) the variable combustion layer C is uniformly formed along the entire periphery of the fuel gas stream a, and (2) dilution of the fuel gas stream A by outward diffusion thereof can be prevented and the fuel gas stream A is discharged in the form of a thin layer into the final combustion space D through the final gas openings 9. As a result, even just after ignition, the fuel gas stream A is effectively heated by the heat of the variable combustion layer C and causes of incomplete combustion such as dilution of the fuel gas, formation of a thick layer of the fuel gas and low temperature combustion can be effectively eliminated. Furthermore, since the air stream B becomes a very strong rising stream in the vicinity of the periphery of the fuel gas openings 5, there is attained another effect that (3) the fuel gas A flown into the gas chamber 7 from the fuel gas openings 5 is promptly introduced as a rising stream into the final combustion space D through the final gas openings 9 by the strong rising air stream B. Therefore, incomplete combustion by cooling of the fuel gas stream A in the gas chamber 7 can be prevented more effectively.

When the open area of the air openings 10 is largest (FIGS. 1 and 2), by increase of the dynamic pressure of air the variable combustion layer C is formed in a zone connecting the fuel gas openings 5 to the final gas openings 9 or in the vicinity of such zone, resulting in increase of the heat generated in the variable combustion layer C or increase of the heat transferred to the fuel in the fuel chamber 1. Accordingly, the amount of the fuel gas generated per unit time is increased and this increase of the amount of the fuel gas generated per unit time results only in an increase of the flow rate of the fuel gas stream but does not cause substantial deviation of the position of the variable combustion layer C. As the open area of the air openings 10 is gradually reduced (FIG. 3), the flow rate of the air stream B is reduced to lower the dynamic pressure of the air, whereby the variable combustion layer C is gradually spaced from the zone connecting the fuel gas openings 5 to the final gas openings 9 and the amount of the heat generated in the variable combustion layer C is gradually reduced and the amount of the heat transferred to the fuel in the fuel chamber 1 is similarly reduced.

As will be apparent from the foregoing illustration, according to the present invention, by a simple operation of changing the amount of air flown into the burner, the heating power can be changed promptly by many stages in a broad region and the maximum heating power can be uniformly maintained at a level necessary and sufficient for ordinary cooking or the like throughout the burning operation, namely at ignition, during normal combustion and just before exhaustion of the fuel.

Still further, in the present invention, since the fuel gas stream A and the air stream B are dynamically balanced with each other in the gas chamber 7 and in this balanced state the variable combustion layer C is formed in the boundary between the two streams, even just before exhaustion of the fuel, namely when the amount of the fuel gas generated is being reduced, the variable combustion layer C moves in such a direction as reducing the thickness of the fuel gas layer A and hence, the fuel can be burnt completely.

In the present invention, the peripheral side wall 24 of the gas chamber has the following function in addition to the above-mentioned functions.

This peripheral side wall 24 of the gas chamber is heated by the heat conducted from the ceiling wall 8 of the gas chamber or by the heat radiated from the variable combustion layer C, and the heat of the peripheral side wall 42 is transferred to the peripheral side wall 4 of the fuel chamber which confronts the peripheral side wall 24 by heat conduction, radiation or heat transfer by air and this heat is finally transferred to the fuel in the fuel chamber. Thus, according to the present invention, the amount of the liquid fuel gasified per unit time can be effectively adjusted depending on a desirable heating power.

In the present invention, if an arrangement is made so that the innermost face of the gas chamber 7 is defined by the cylindrical or tapered central wall 41, the foregoing effects can be attained more prominently. More specifically, since the central inner wall 41 has a cylindrical or tapered configuration, the resistance to the rising fuel gas stream A by contact with the wall 41 is maintained at a lowest level, and therefore, the fuel gas stream A in which primary combustion has already started in the variable combustion layer C is discharged into the final combustion space D through the final gas openings 9 without being substantially cooled even just after ignition by the inner wall 41 still maintained at room temperature. Thus, incomplete combustion of the fuel gas stream A at the time of ignition by cooling can be effectively prevented. Furthermore, the variable air stream B is present on the periphery of this fuel gas stream A as described hereinbefore and the inner circumference of the fuel gas stream A is defined by the inner wall 41. Accordingly, the fuel gas is prevented from diffusing outwardly or inwardly in the horizontal direction, and the fuel gas is discharged into the final combustion space D in the form of a very thin layer. As a result, incomplete combustion by dilution of the fuel gas or incomplete combustion of the inner fuel gas by increase of the thickness of the flame E can be effectively prevented. Still in addition, since the thickness of the fuel gas stream A is reduced and the variable combustion layer C (primary combustion layer) is formed in the vicinity of the thin-layer fuel gas stream A to surround it, the fuel gas stream A per se or the inner face of the inner wall 41 is heated to a high temperature in a very short time from the point of ignition by convection, conduction or radiation of heat, and elimination of causes of incomplete combustion is further enhanced. Thus, in this embodiment of the present invention, even just after ignition, namely even when incomplete combustion takes place most readily, occurrence of incomplete combustion can be prevented very effectively.

In the present invention, when the above-mentioned important feature (iv) is realized, the heat generated in the variable combustion layer C and the heat of the cylindrical or tapered central inner wall 41 are effectively transferred to the fuel (not shown) in the space 6 of the fuel chamber through the ceiling wall 42 of the fuel chamber 1 or the peripheral side wall 4 thereof, and the amount of the liquid fuel gasified per unit time to a combustible gas can be effectively increased in any stage of the burning operation, namely just after ignition, during normal combustion or just before exhaustion of the fuel, so that a desirable heating power can be obtained.

In the present invention, the height (ho), namely the distance in the vertical direction between the fuel gas opening 5 and the final gas opening 9, is preferably chosen in the range of 4 to 40 mm, especially 6 to 20 mm, so that an effective variable combustion layer C is formed and the pressure loss of the fuel gas stream is not large, through the preferred height (ho) varies to some extent depending on the size of the burner or the required maximum heating power. It also is preferred that the fuel gas opening 5 be disposed so that when it is seen in the vertical direction, at least a part of the fuel gas opening 5 is present outwardly of the lower end edge of the inner wall 41. In view of prevention of undulation of the flame described hereinafter, it is preferred that the height (hi) from the lower end of the air opening 10 or communication opening 30 to the final gas opening 9 be 1.1 to 10 times, especially 1.1 to 5 times, as large as the above-mentioned height (ho). In order to attain the foregoing objects, it is preferred that the angle of inclination of the central inner wall 41 to the vertical direction be in the range of 0° to 60°, especially 0° to 50°.

In order to prevent the above-mentioned undulation or intermission of the flame, in the present invention, it is preferred that the air passage 39 be extended substantially in the vertical direction and the sectional area of the air passage 39 in the horizontal direction be gradually increased toward the top portion.

Referring now to FIGS. 1 and 2, the inner faces of the peripheral side walls 18 and 24 of the gas chamber of the burner proper 2 are substantially vertical and the outer face of the peripheral side wall 4 of the fuel chamber 1 is a downwardly expanded inclined face. Accordingly, between the inner faces of the side walls 18 and 24 and the side wall 4 there is formed an annular passage 39 extended in the vertical direction so that the sectional area of the passage 39 in the horizontal direction is gradually increased upwardly.

When the feeble heating power state (completely closed state) is converted to the open state in the air openings 10 or when the air openings are kept in the slightly opened state, undulation or intermission of the flame E is readily caused to occur. It is believed that occurrence of this undesirable phenomenon is due to repetition of the following process:

(1) A fuel-air mixture having a combustible mixing ratio (within the explosion limit) is formed prevailingly in the gas chamber 7 including the space 39.

(2) The so formed air-fuel mixture is instantly and violently burnt to form a high pressure combustion gas in the gas chamber 7 including the space 39.

(3) Supply of air into the gas chamber 7 is stopped by the pressure of the so formed combustion gas and hence, combustion in the gas chamber 7 is extinguished and the variable combustion layer C is not formed.

(4) The above steps (1) to (3) are repeated.

In this embodiment of the present invention, however, by forming and arranging the space 39 in the foregoing specific manner, even if a combustible gaseous mixture formed at the step (1) is burnt, the resulting combustion gas is selectively discharged from the final gas openings 9 in the form of a vigorous rising stream and simultaneously with discharge of the combustion gas, air is sucked and introduced into the gas chamber 7 through the air openings 10 and a stable variable combustion layer C is immediately formed. As a result, undulation or intermission of the flame E can be effectively prevented.

In view of the mechanical strength of the burner and the production easiness, it is preferred that the inner wall 41 as well as the central bottom wall 44 downwardly projected through the inner wall 41 be formed integrally with the ceiling wall 8 of the gas chamber. Furthermore, it is preferred that the central bottom wall 44 be indented below a plurality of annularly arranged and distributed final gas openings 9 and a space F be formed in the indented portion (see FIG. 6), because effects such as mentioned below can be attained by this arrangement.

Figure 6:
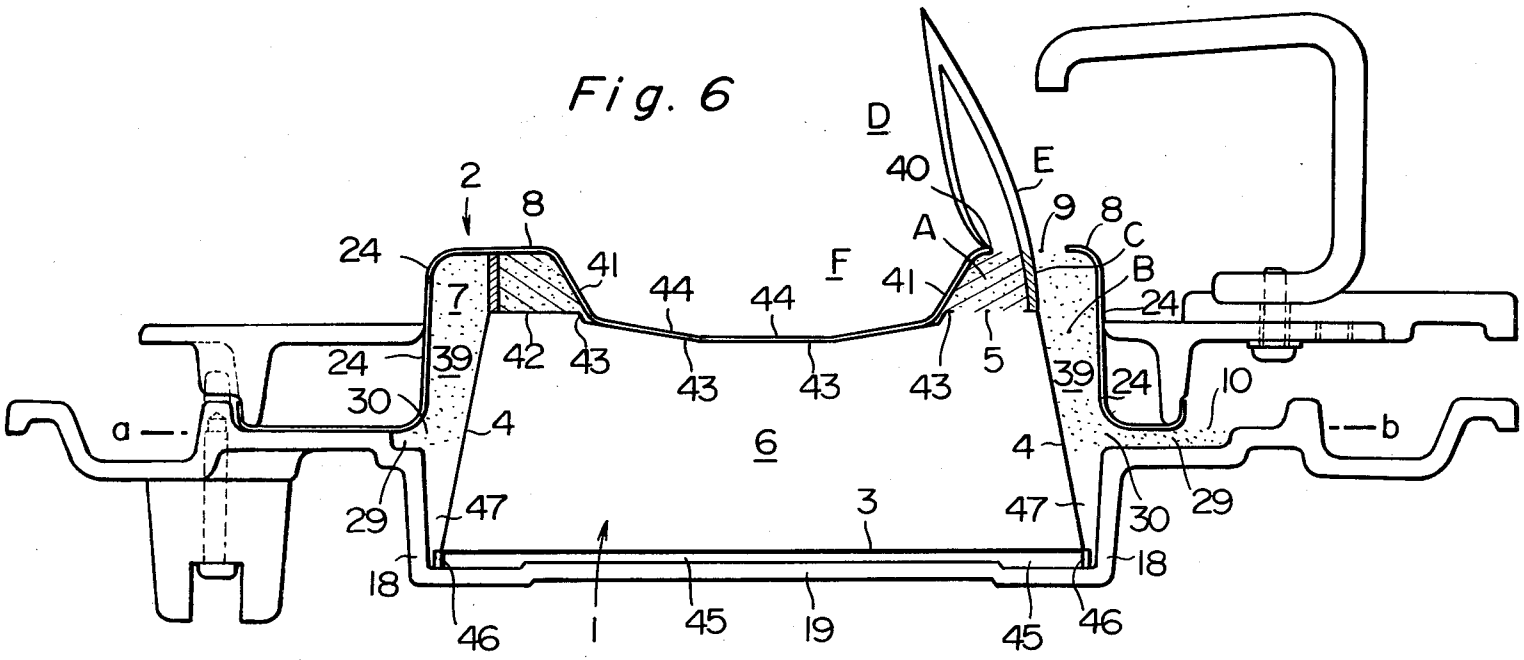
FIG. 6 is a diagram illustrating the principle of the present invention by reference to the embodiment shown in FIGS. 1 and 2.

Referring now to FIG. 6, air is readily flown into the space F in the indented portion through clearances among a plurality of flames E to promote complete combustion of the fuel gas stream rising in the final combustion space D through the final gas openings 9. Further, just after ignition, the cooling effect of the low temperature surface of the ceiling wall 8 of the gas chamber on the fuel gas stream in the final combustion space D is reduced and moderated, and during normal combustion, superheating of the surface of the ceiling wall 8 of the gas chamber 7 by the flame E can be prevented.

Figure 7:
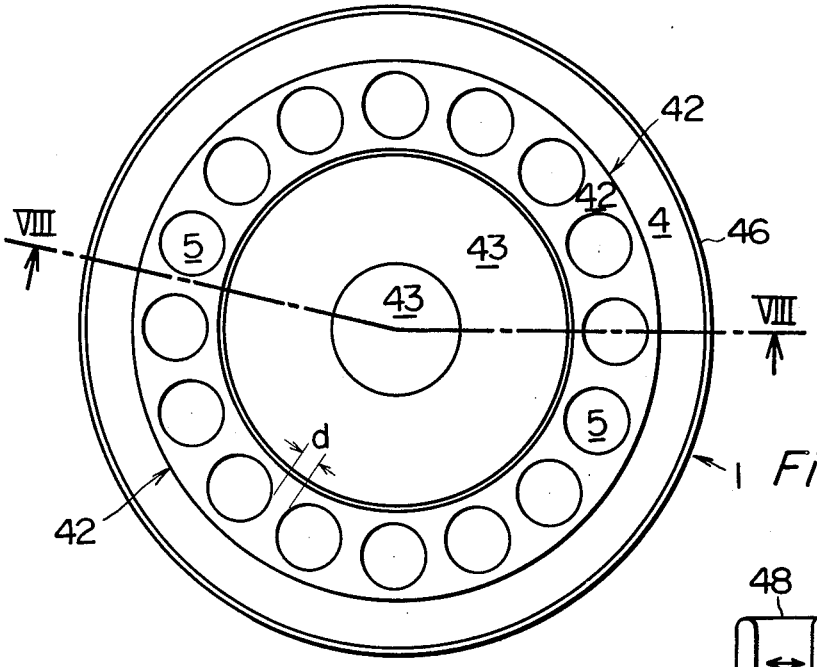
FIG. 7 is a top view showing independently a fuel chamber of the burner shown in FIGS. 2 or 5.
Figure 8:
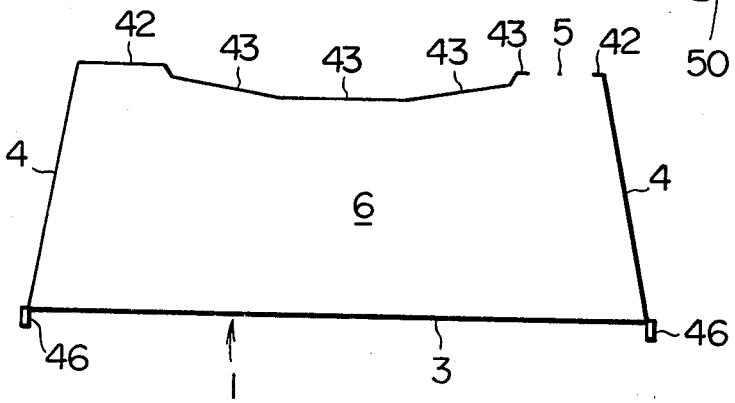
FIG. 8 is a view showing the section of the fuel chamber taken along the line VIII—VIII in FIG. 7.

Referring now to FIGS. 7 and 8, the fuel chamber 1 has a ceiling wall 42 formed integrally with the peripheral side wall 4, and a number of fuel gas openings 5 are annularly arranged at small intervals on the outer edge portion of the ceiling wall 42. The central portion 43 of this ceiling wall 42 surrounded by these fuel gas openings 5 is preferably connected to the central bottom wall 44 of the ceiling wall 8 of the gas chamber so that the heat can be transferred between the central portion 43 and the wall 44 as described hereinbefore with respect to the embodiment shown in FIG. 2. By adoption of such structure, the heat arriving at the cylindrical or tapered central inner wall 41 is transferred to the central portion 43 of the ceiling wall 42 of the fuel chamber 1 or further to the peripheral wall 4 or bottom wall 3 through the central bottom wall 44 of the ceiling wall 8 of the gas chamber, whereby the amount of the fuel gas generated, namely the heating power, can be changed promptly and precisely in follow-up of the change of the open area of the air openings 10, namely the change of the amount of air flown into the gas chamber 7.

In order that the fuel gas is uniformly annularly ignited by inserting an ignition source such as a lighted match into the gas chamber 7 through one final gas opening 9 and bringing it close to one fuel gas opening 5, it is preferred that the clearance d between every two adjacent fuel openings 5 be smaller, but in order that the heat is easily and promptly conducted from the central portion 43 of the ceiling wall of the fuel chamber 1 to the wall 4 or 3 or in view of the strength of the burner, it is preferred that the clearance d be larger. Thus, the clearance d is preferably chosen in the range of 1 to 30 mm, especially 1.5 to 15 mm, so that both of the above two requirements are satisfied.

In the present invention, in order to uniformalize the maximum heating power throughout the burning operation, namely just after ignition, during normal combustion and just before exhaustion of the fuel and to shorten the time lag in adjustment of the heating power, it is important that the fuel chamber 1 is formed independently from the burner proper 2. More specifically, the heat transferred to the central portion 43 of the ceiling wall of the fuel chamber through the above-mentioned central inner wall 41 and central bottom wall 44 and the heat transferred to the peripheral side wall 4 from the peripheral side wall 24 of the gas chamber are substantially used for gasification of the fuel and therefore, uniformalization of the maximum heating power is possible. Further, the overall heat capacity of the fuel chamber 1 and burner proper 2 disposed so that the heat can easily be conducted between the two chambers becomes small, and in response to the change of heat generation in the variable combustion layer C, which is caused depending on the opening degree of the air openings 10, the temperature of each of the walls 42, 4 and 3 of the fuel chamber 1 is sharply changed in a short time, whereby the amount of the fuel gasified per unit time in the fuel chamber 1 is promptly changed and the time lag in the heating power adjustment can be shortened. In order to embody this feature conveniently, it is preferred that a heat-insulating space be formed between the fuel chamber 1 and the burner proper 2 except portions of the central bottom wall 44 and peripheral side wall 24 in the gas chamber of the burner proper 2. Accordingly, a peripheral projection 46 is formed in the lower end peripheral portion of the fuel chamber 1 to form a heat-insulating space 45 of a small clearance between the bottom wall 19 of the burner proper 2 and the bottom wall 3 of the fuel chamber 1. Moreover, another heat-insulating space 47 is formed between the lower portion of the outer face of the peripheral side wall 4 of the fuel chamber and the lower portion of the inner face of the peripheral side wall 18 of the gas chamber.

In order to supply stably a combustible gas generated in the space 6 into the gas chamber 7 through the fuel gas openings 5, it is preferred that the central portion 43 of the ceiling wall of the fuel chamber be upwardly inclined or stepped.

In order to perform transfer of the combustion heat in the gas chamber 7 to the fuel chamber 1 effectively with a reduced time lag and to reduce the time lag in the heating power adjustment and uniformalize the maximum heating power in any stage during the period ranging from the point just after ignition to the point just before exhaustion of the fuel, it is preferred that at least the ceiling wall 42, especially all the walls of the fuel chamber 1, be composed of a thin metal material having a good heat conductivity, such as an aluminum foil and that in the inner space 6 of the fuel chamber, the liquid fuel be contained in the state held by a liquid-absorbing elastic material. As the liquid-absorbing elastic material, there are preferably employed fillers of incombustible fibers such as glass fibers, rock wool and slag wool and incombustible or flame-retardant foamed products of the continuous cell type. In this embodiment, even if air is incorporated in the fuel chamber 1 and a fuel gas-air mixture included within the explosion limit is formed, explosion of the gaseous mixture can be effectively prevented. Further, overflowing of the fuel outside the fuel chamber 1 is effectively prevented. Moreover, this elastic material brings about an elastic and close connection between the central portion 43 of the ceiling wall of the fuel chamber and the central bottom wall 44 of the ceiling wall of the gas chamber even if the ceiling wall 42 of the fuel chamber is extremely thin, and therefore, a much better heat conduction can be attained between the central portion 43 and the central bottom wall 44.

In the burner of the present invention, (1) prevention of incomplete combustion at ignition and (2) increase of the region of the heating power adjustment in response to the amount of air flown in the gas chamber 7 include factors contradictory to each other. More specifically, in order to attain the effect (1), it is preferred that the heat conductivity of a passage for transfer of heat from the ceiling wall 8 of the gas chamber to the fuel chamber be as low as possible. On the other hand, in order to attain the effect (2), it is preferred that the heat conductivity of this heat transfer passage be as high as possible. However, this contradiction can be eliminated or moderated by forming the central inner wall 41 to have a cylindrical or tapered shape, constructing the ceiling walls 8, 41 and 44 of the gas chamber by using a metal material having a relatively low heat conductivity such as thin stainless steel or steel and constructing the walls 42, 43, 4 and 3 of the fuel chamber by using a metal material having a relatively high heat conductivity such as thin aluminum or copper.

Various modifications may be made to the above-illustrated burner of the present invention so far as they do not deviate from the spirit of the present invention.

Figure 9:
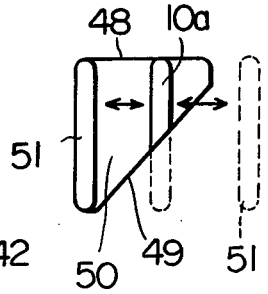
FIG. 9 is a diagram illustrating the operation of adjusting variable air openings in the burner shown in FIG. 5.

For example, in order to perform the heating power adjustment by many stages in a broad region, uniformalize and increase the maximum heating power and prevent incomplete combustion, it is preferred that the vertical size of the annular variable air passage 39 be large, and in order to prevent undulation and intermission of flames it is preferred that the vertical size of the passage 39 be as small as possible. These contradictory requirements are simultaneously satisfied very effectively in the embodiment shown in FIG. 5. In the embodiment shown in FIG. 5, cylindrical or tapered outer side walls 18a and 33 are disposed so that they slide relatively to each other, and on one of the two walls, for example, the wall 33, there is formed a first opening 50 in which, as shown in FIG. 9, the inclination angle of the lower end edge 49 is larger than the inclination angle of the upper end edge 48 (horizontal in FIG. 9) and the vertical distance between the upper end edge 48 and the lower end edge 49 is gradually changed from the maximum size to the minimum size, and on the other side wall 18*a* there is formed a long second opening 51 having a vertical opening size sufficient to cover the upper end edge 48 and lower end edge 49 of the first opening 50. Accordingly, in FIG. 9 the overlap area of the second opening 51, namely the open area of the air openings 10*a*, is maximum at the leftmost position, and this area is gradually reduced toward the right and at the rightmost position the air openings are completely closed. If such structure of the air openings is adopted, in the state where the air openings are completely opened, the average distance from the air openings 10*a* to the final gas openings 9 in the annular passage 39 is longest and in the state where the air openings are slightly opened, this distance in the passage 39 is shortest. Therefore, in this arrangement, it is possible to form a uniform annular rising stream as the variable air stream B while bringing the air openings 10*a* and final gas openings 9 close to each other, and as a result, the above-mentioned contradictory requirements can be simultaneously satisfied.

In order to prevent undulation and intermission of flames, it is preferred to narrow the space other than the variable air passage B and fuel gas passage A formed in the gas chamber 7 as much as possible and to maintain a space for smooth combustion of the fuel gas filled in the gas chamber 7 in the vicinity of the lower end of the flow passage 39, namely in the vicinity of the communication hole 30 to the air openings (or the air openings 10*a*). Embodiments of such structure suitable for preventing undulation and intermission of flames are shown in FIGS. 10, 11, 12 and 17.

Figure 10:
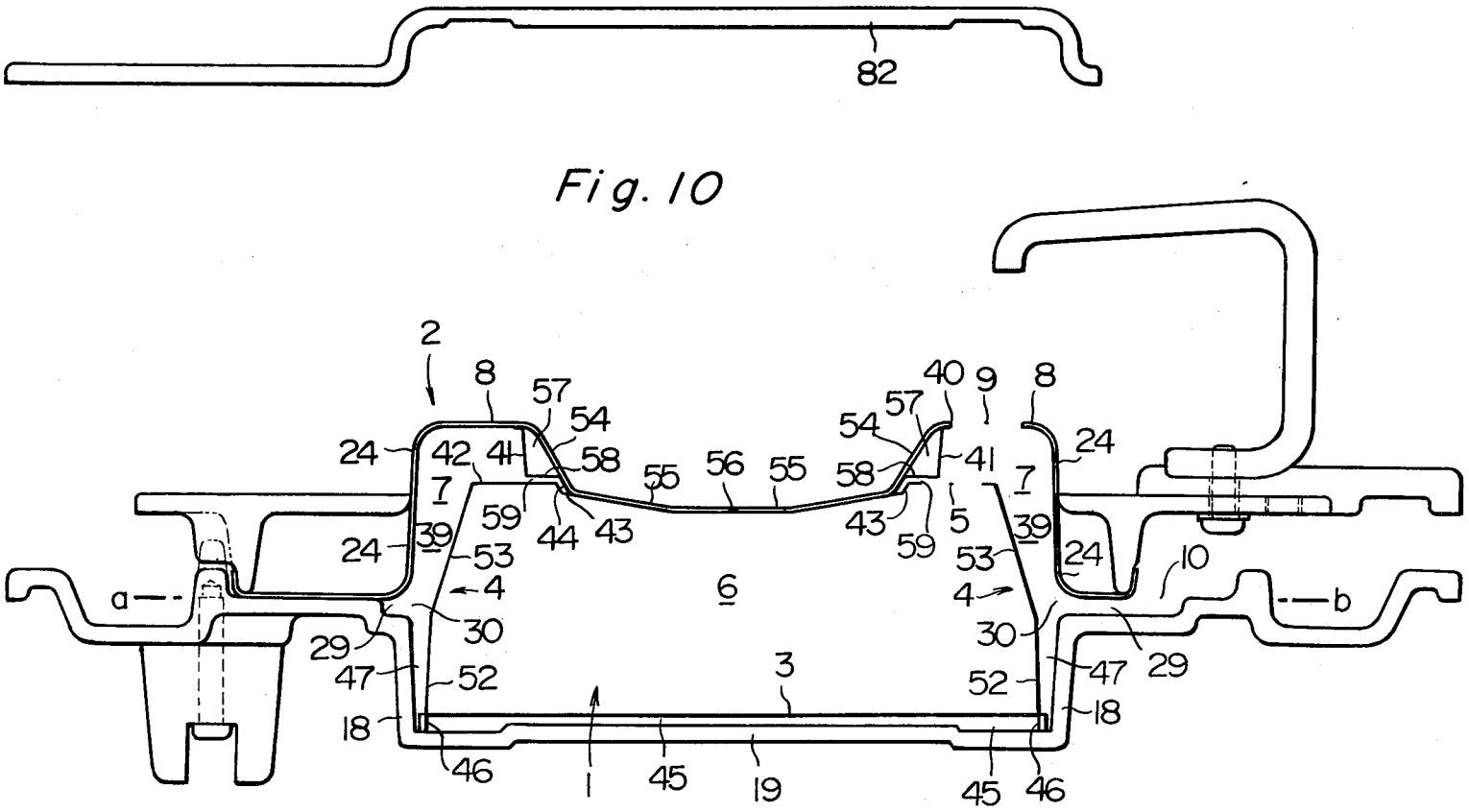
FIG. 10 is a sectional side view of still another embodiment of the burner of the present invention which comprises a fuel chamber including a bent peripheral side wall.
Figure 17:
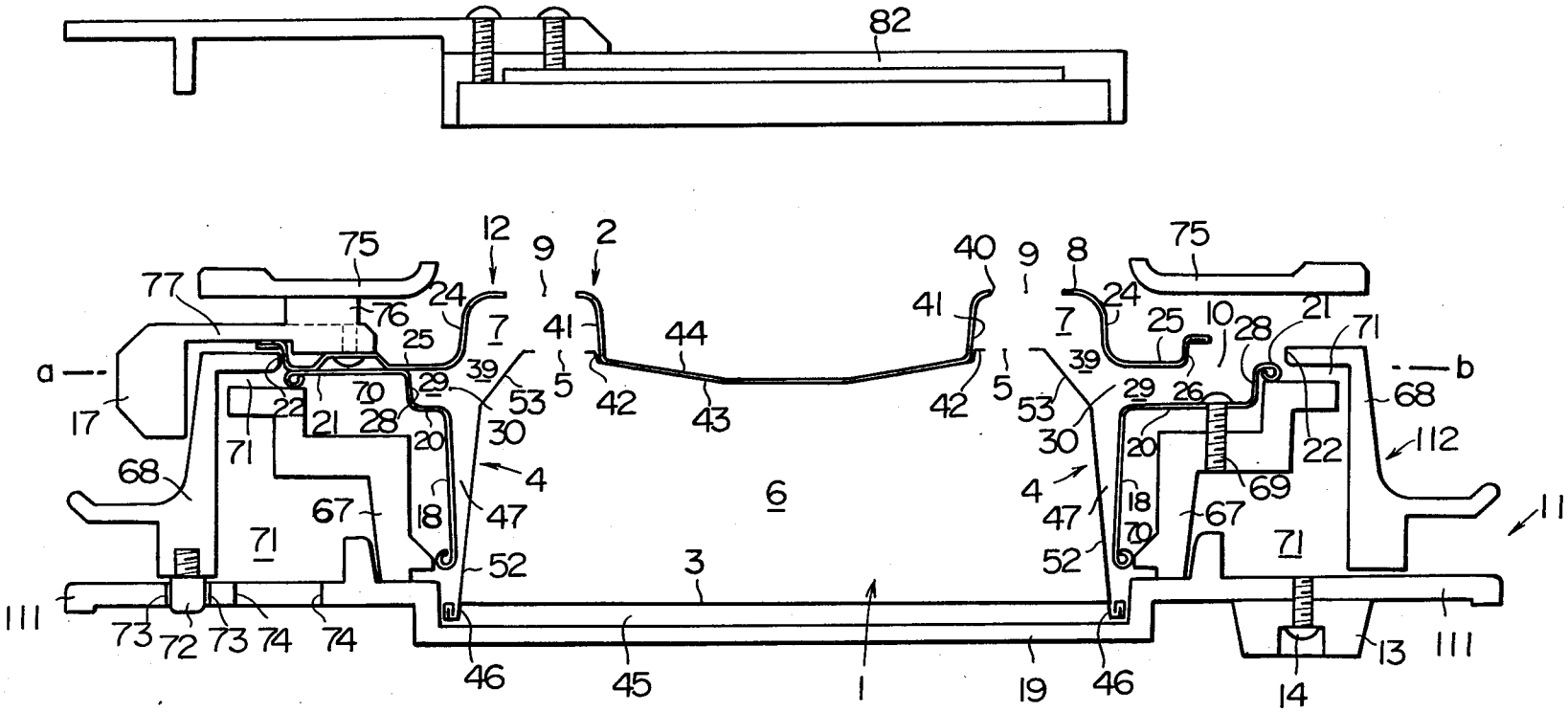
FIG. 17 is a section taken along the line XVII—XVII in FIG. 16.

In the embodiment shown in FIGS. 10 and 17, the outer face of the peripheral side wall 4 of the fuel chamber is bent at a height corresponding to the height of the vicinity of the lower end of the annular air passage 39, whereby the outer face of the side wall 4 is divided into a lower portion 52 of a steep inclination and an upper portion 53 of a gradual inclination.

Figure 11:
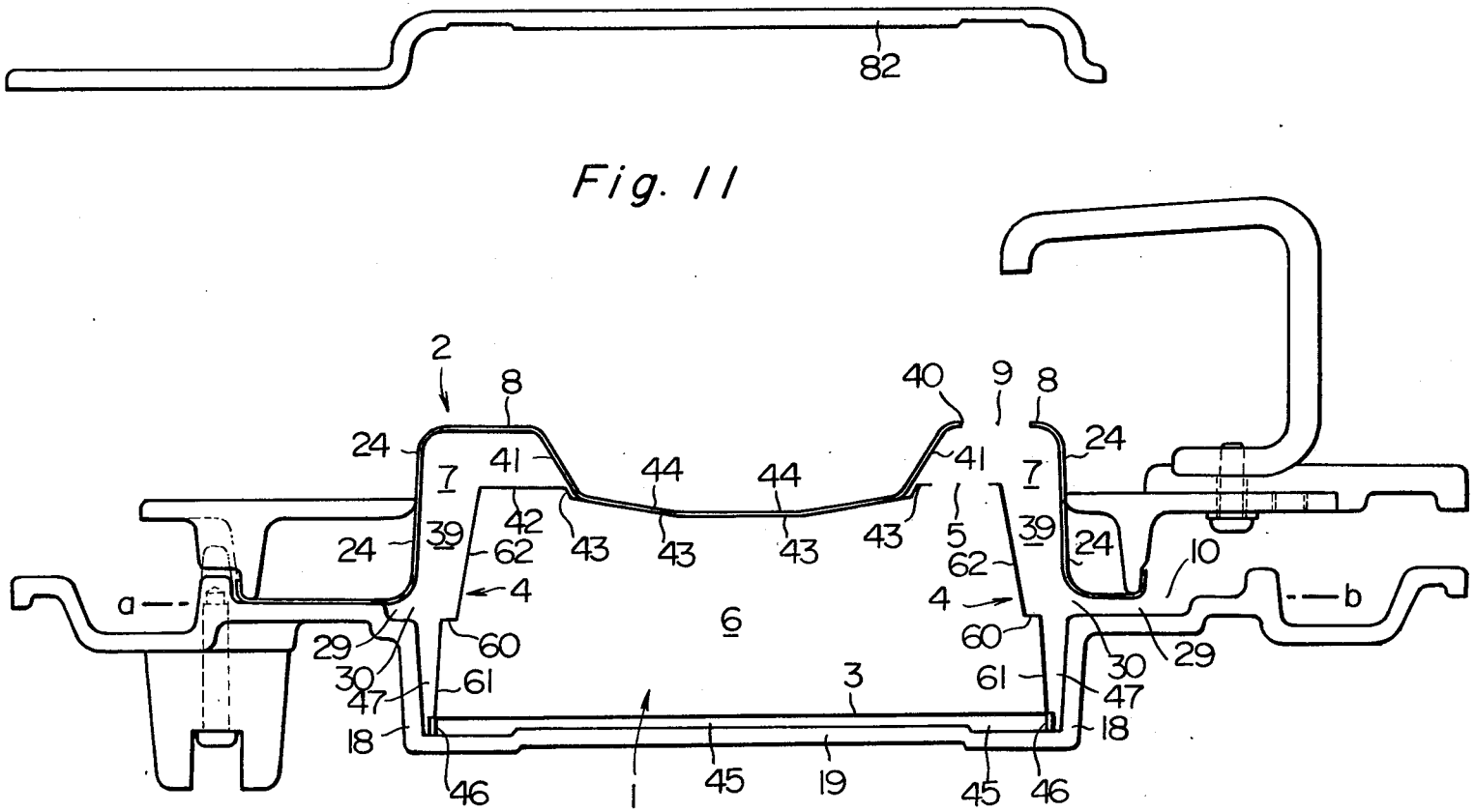
FIG. 11 is a sectional side view of still another embodiment of the burner of the present invention which comprises a fuel chamber including a peripheral side wall having a shoulder portion.

In the embodiment shown in FIG. 11, at a height corresponding to the height of the vicinity of the lower end of the annular air passage 39 the outer face of the annular side wall 4 of the fuel chamber is divided into a lower portion 61 of a relatively large diameter and an upper portion 62 of a relatively small diameter through a shoulder 60.

Figure 12:
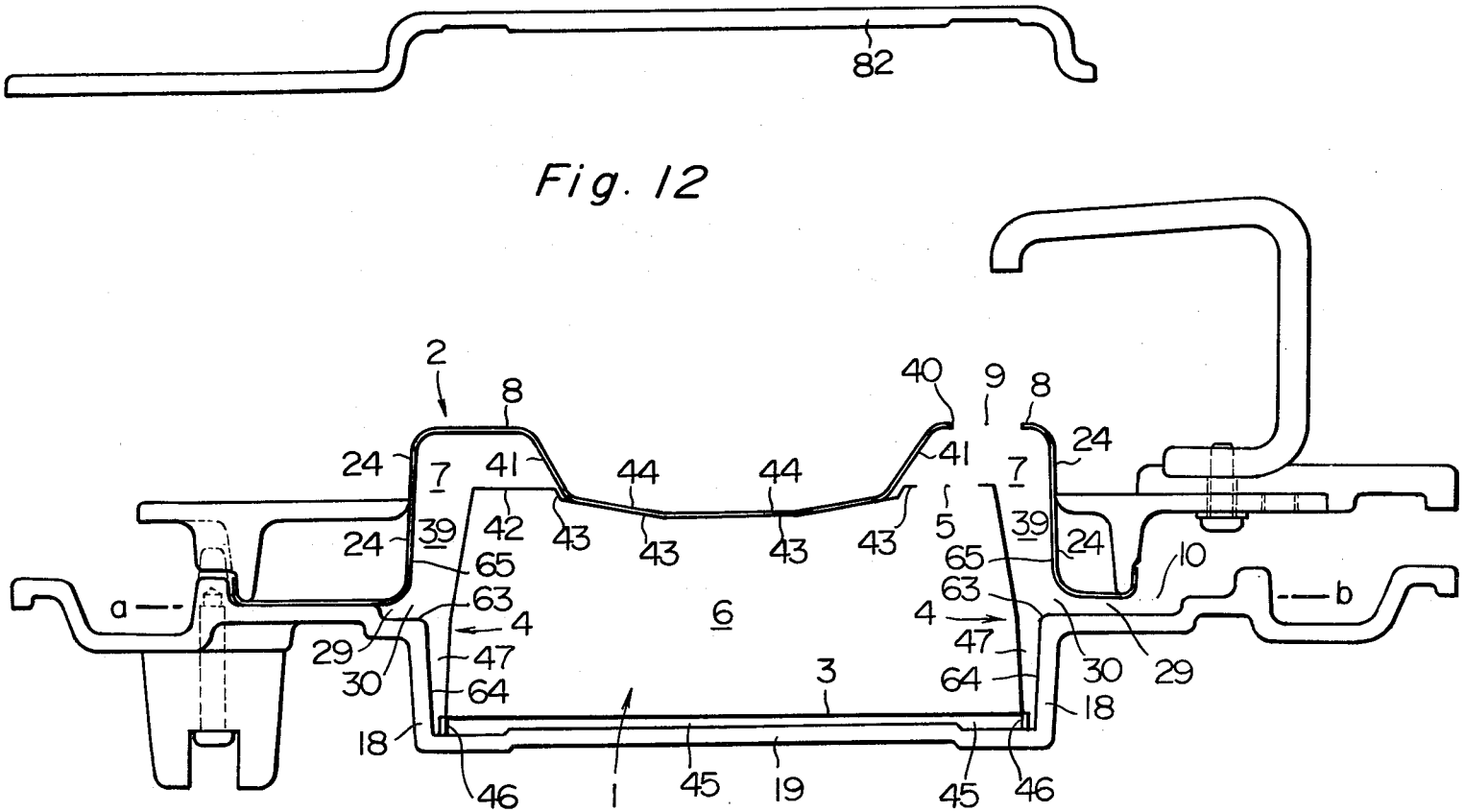
FIG. 12 is a sectional side view of still another embodiment of the burner of the present invention which comprises a gas chamber including an outer peripheral side wall having a shoulder portion.

In the embodiment shown in FIG. 12, the peripheral side walls 18 and 24 of the gas chamber have a shoulder 63 at a height corresponding to the height of the vicinity of the lower end of the annular air passage 39, and each wall is divided into a lower portion 64 having a relatively small diameter and an upper portion 65 having a relatively large diameter through the shoulder 63.

In the embodiment shown in FIG. 10, the central portion of the ceiling wall 8 of the gas chamber surrounded by the final gas openings 9 is composed of a cylindrical or tapered central outer wall 54, an outer bottom wall 55 projected downwardly through the central outer wall 54, a thin cylindrical or tapered central inner wall 41 located at an inner position and an inner bottom wall 44 projected downwardly through the central inner wall 41 so that a heat-insulating space 57 is formed. The inner wall 41 and bottom wall 44 and the outer wall 54 and bottom wall 55 are integrated by spot welding of the central portions of the bottom walls 44 and 55, respectively, as indicated by reference numeral 56, and the bottom walls 44 and 55 are contacted with each other so that heat can be conducted therebetween.

In the embodiment shown in FIG. 10, it is possible to reduce the heat capacity of the central inner wall 41, and discharge of the heat from the wall 41 into the outside of the burner can be reduced. As a result, it is possible to adjust the quantity of heat transferred to the fuel chamber, namely the amount of the fuel gas generated, by many stages in a broad region more sharply in response to the change of the position of the variable combustion layer, and it also is possible to prevent incomplete combustion at the time of ignition.

Further, in the embodiment shown in FIG. 10, the above-mentioned wall 41 has a substantially horizontal bottom wall side edge portion 58 connected to the lower end edge of the wall 41 and covering partially the upper portion of the fuel gas opening 5, and an annular communication groove 59 having a small size in the vertical direction is formed between the inner face of the bottom wall end edge portion 58 and the fuel gas opening 5. This groove 59 has an effect of distributing uniformly and annularly the fuel gas introduced into the gas chamber 7 through the fuel gas opening 5 even just after ignition, whereby even if ignition is effected on one spot, the fuel gas is easily ignited throughout the final gas openings 9 in a very short time. As pointed out hereinbefore, when the distance d (see FIG. 7) between every two adjacent fuel gas openings 5 formed on the ceiling wall 42 of the fuel chamber is large, entire ignition is often difficult. However, according to this embodiment of the present invention, even if the distance d is large, ignition is accomplished very easily on all of the final gas openings 9. Further, since the distance d is relatively large in this embodiment, conduction of heat to the peripheral side wall 4 of the fuel chamber from the ceiling walls 43 and 42 of the fuel chamber is enhanced and uniformalization of the maximum heating power and multi-stage broad region adjustment of the heating power can easily be accomplished.

Figure 5:
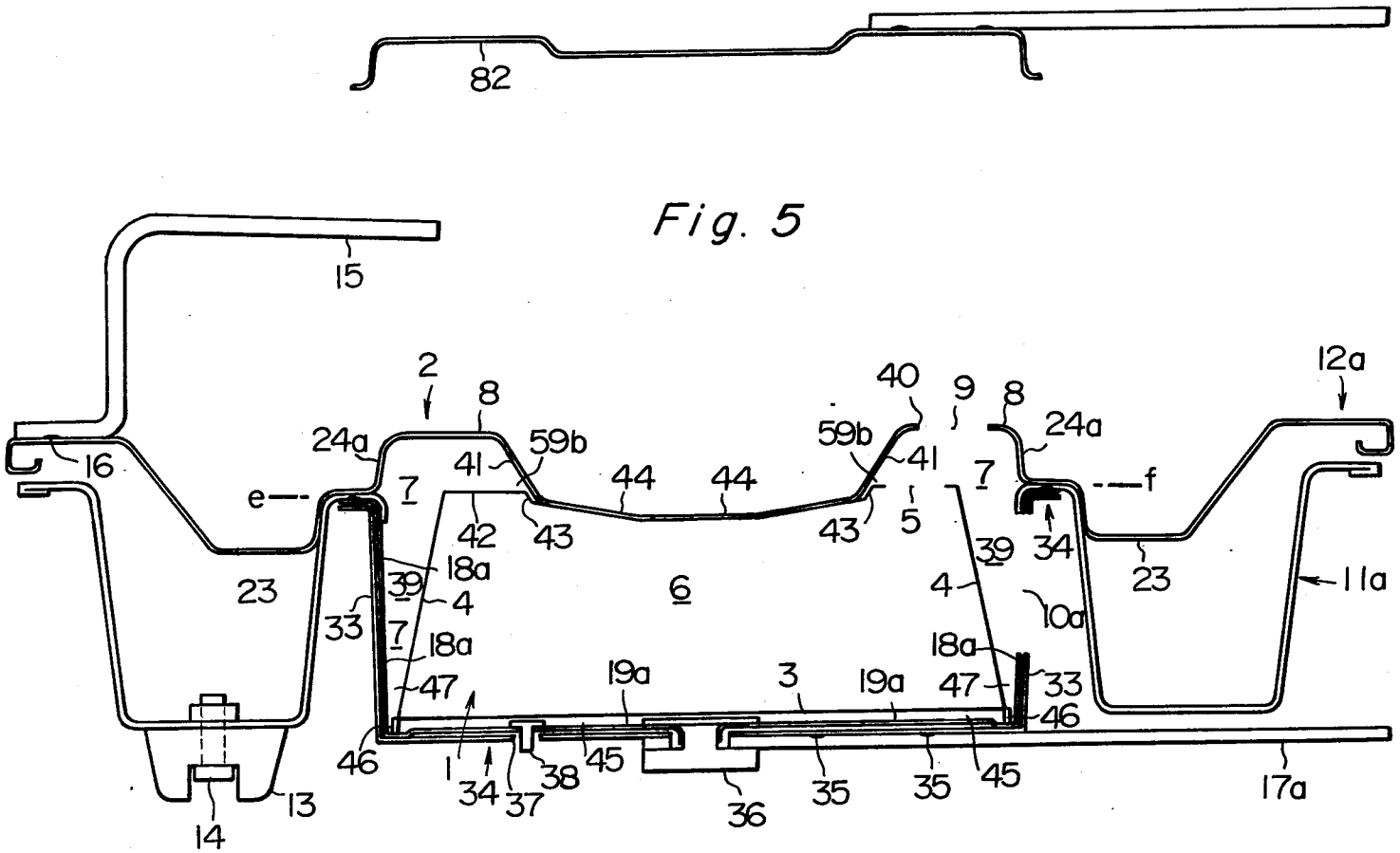
FIG. 5 is a sectional side view showing another embodiment of the burner of the present invention.

Also in the embodiment shown in FIG. 2 or 5, the central inner wall 41 has a tapered shape and is extended to cover a part of the fuel gas opening 5, and an annular groove 59*b* having a small size in the vertical direction and being covered by the inclined inner face of the central inner wall 41 has the same function as that of the above-mentioned groove 59 (see FIG. 10).

Figure 13:
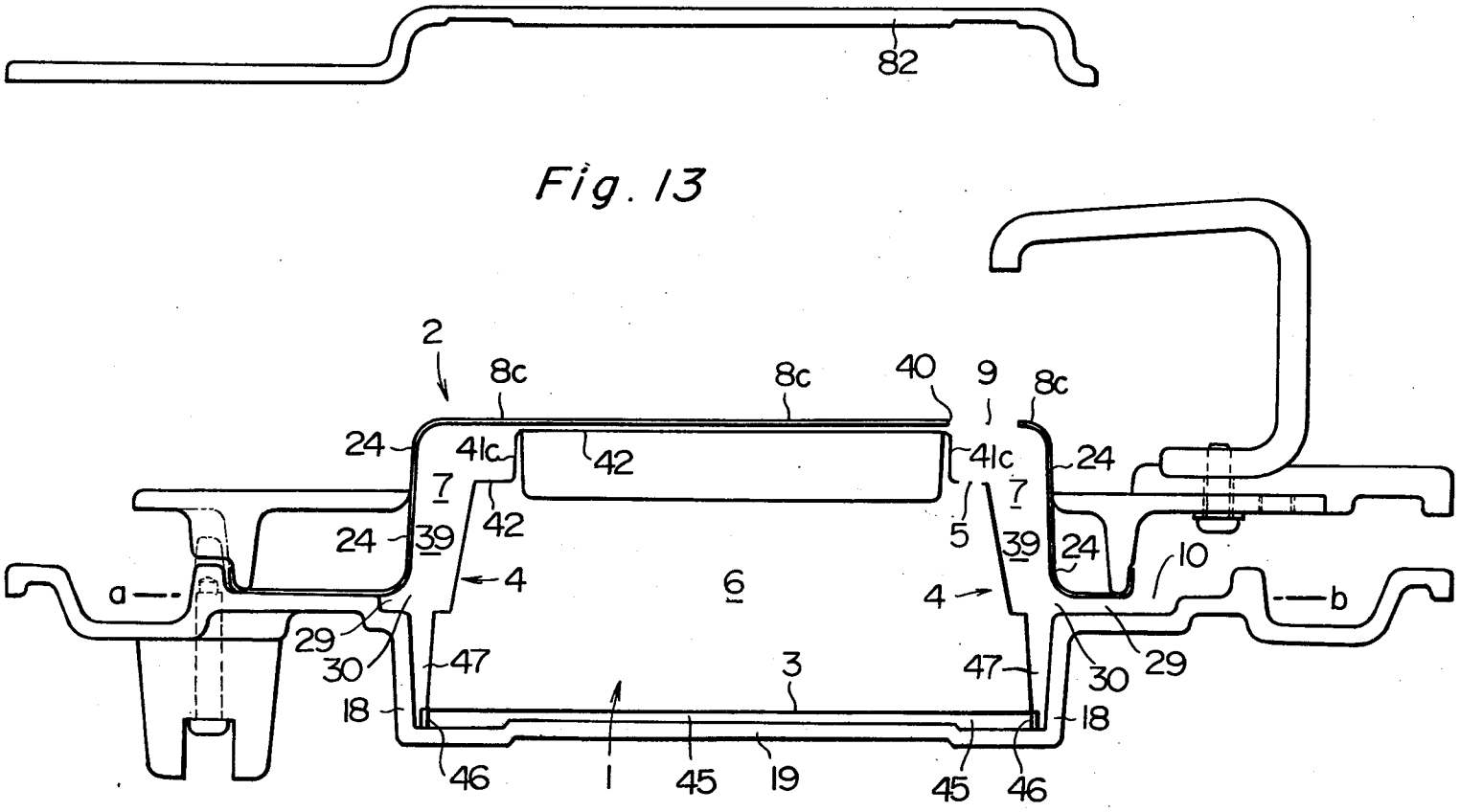
FIG. 13 is a sectional side view of still another embodiment of the burner of the present invention in which a cylindrical or tapered central inner wall is formed integrally with the ceiling wall of the fuel chamber.

In the present invention, the cylindrical or tapered central inner wall 41 may be formed on the ceiling wall 42 of the fuel chamber, though in the foregoing embodiments it is formed on the ceiling wall 8 of the gas chamber. For example, as shown in FIG. 13, the ceiling wall 8*c* of the gas chamber is entirely made flat and a number of fuel gas openings 5 are annularly arranged and distributed on the outer edge portion of the ceiling wall 42 of the fuel chamber. A cylindrical or tapered central inner wall 41*c* is formed integrally with the ceiling wall 42 of the fuel chamber so that it is located near the inner end edges of the fuel gas openings 5.

Figure 14:
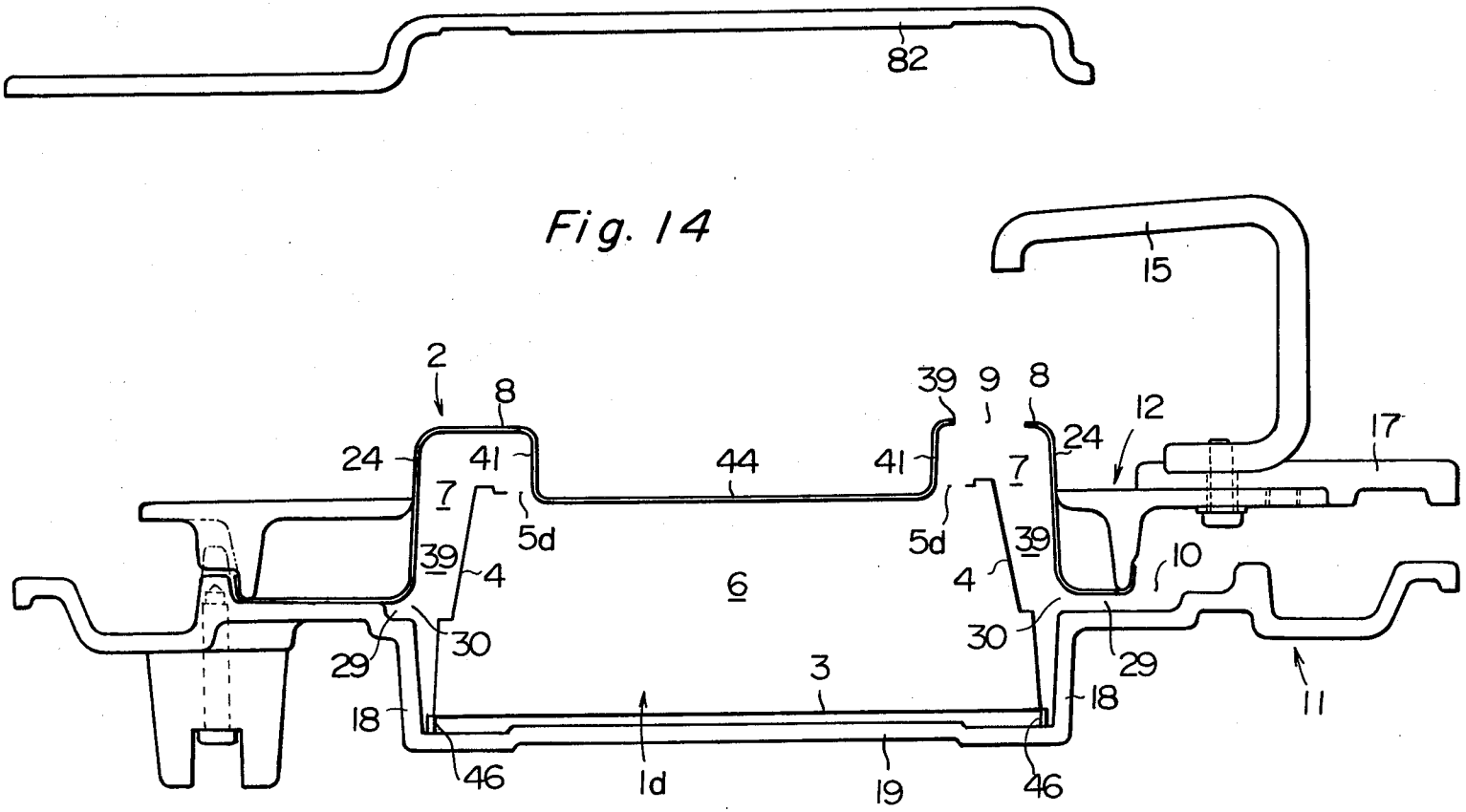
FIG. 14 is a sectional side view of still another embodiment of the burner of the present invention which comprises a fuel chamber having no ceiling wall.

Further, a fuel chamber 1*d* of which the upper portion is entirely opened as shown in FIG. 14 may be used instead of the fuel chamber provided with the ceiling wall 42. Referring to FIG. 14, the upper portion of the fuel chamber 1*d* is entirely opened, and the ceiling wall 8 of the gas chamber has a central bottom wall 44 downwardly projected through a cylindrical or tapered central inner wall 41. The inner face of this central bottom wall 44 also acts as the ceiling wall of the fuel chamber 1*d*, and a narrow annular slit-like fuel gas opening 5*d* is formed between the outer end edge of this central bottom wall 44 and the top end portion of the peripheral side wall 4 of the fuel chamber. This central bottom wall 44 may be located on the same level as that of the top end of the peripheral side wall 4 of the fuel chamber or at a level slightly lower or higher than that of the top end of the wall 4.

Figure 15:
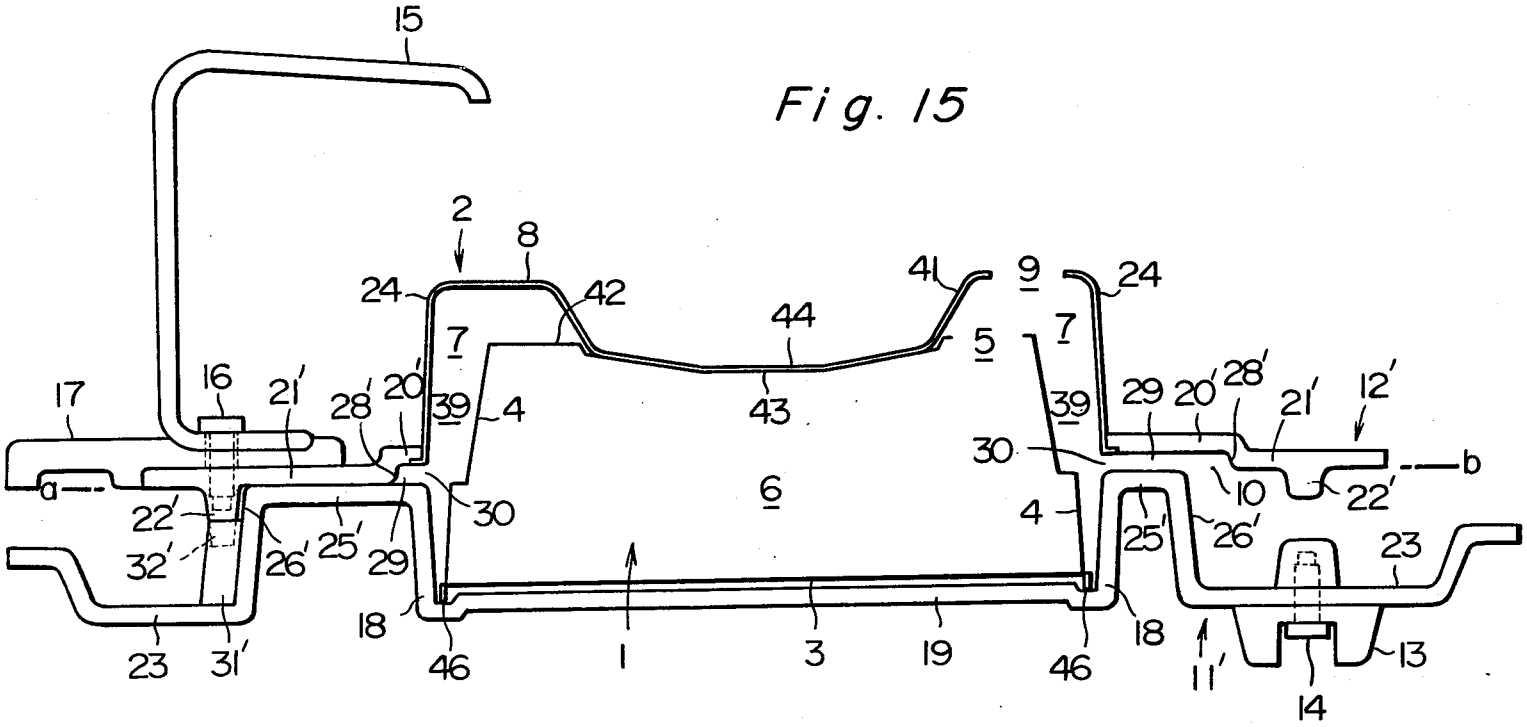
FIG. 15 is a sectional side view of still another embodiment of the burner of the present invention in which variable air openings and connection passage are reversed from the arrangement shown in FIG. 2.
Figure 16:
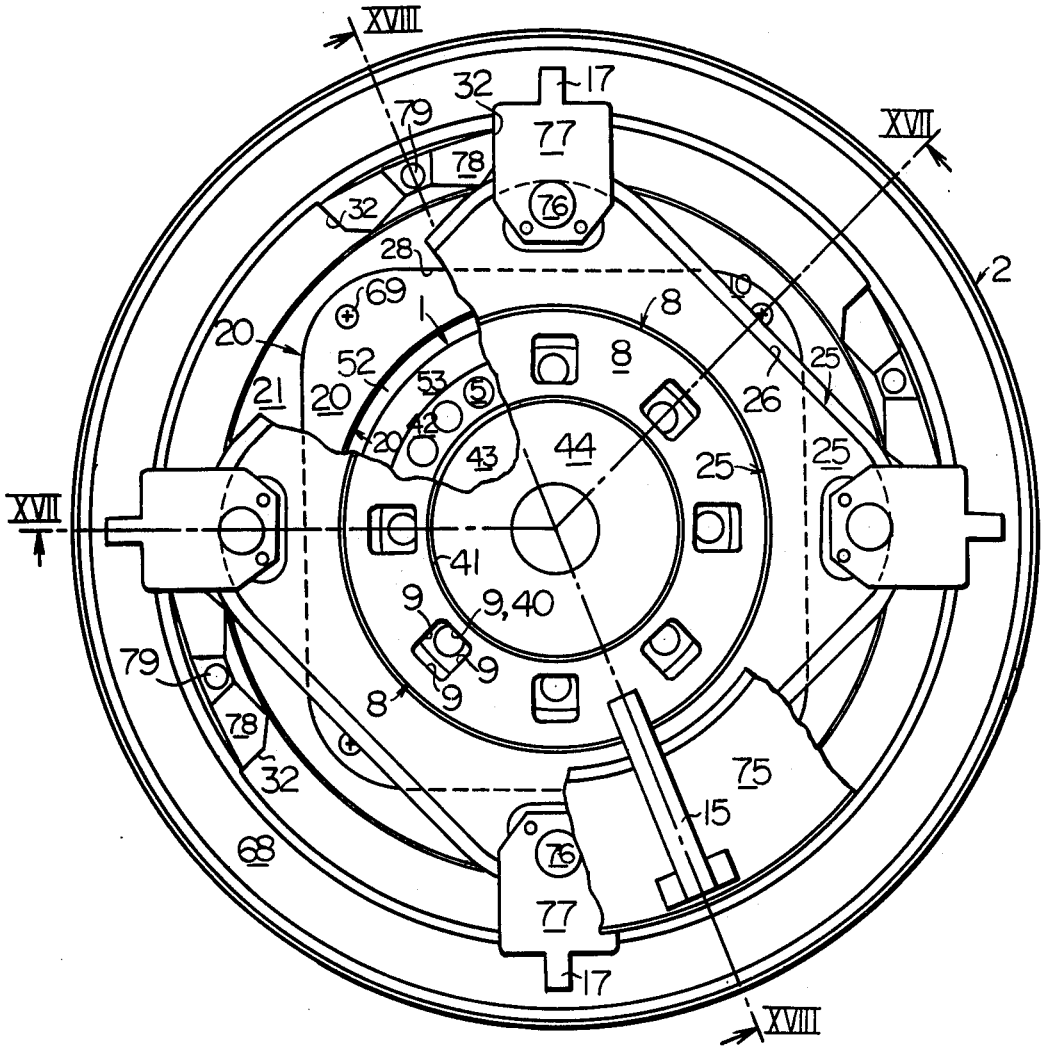
FIG. 16 is a top view illustrating still another embodiment of the burner of the present invention in which a trivet and an upper member are partially cut out for better illustration.

Moreover, as shown in FIG. 15, there may be adopted an arrangement in which a non-circular concave portion 20', a circular plane portion 21', a circumferential step wall portion 22' and a stopper 32' are formed on a upper member 12' and a non-circular projected plane portion 25', its outer end side face portion 26' and an outward projection 31' formed above the corner portion thereof are formed on a lower member 11'. Namely, in this embodiment, the arrangement of the respective parts is reversed to the arrangement shown in FIGS. 1 and 2 with respect to the vertical direction.

Furthermore, the lower member 11 may be composed of a seat member 111 supporting the fuel chamber 1 and a ring member 112 surrounding the lower portion 52 of the peripheral side wall 4 of the fuel chamber 1 and rotatably supporting the upper member 12. The seat member 111 and the ring member 112 are disposed in such a relationship that they can be optionally dismounted and separated from each other and preferably the fuel chamber 1 can be dismounted after the ring member 112 has been dismounted.

The ring member 112 comprises inner and outer frames 67 and 68 clamped to each other by bolts 66 (see FIG. 18) and an integral assembly composed of a thin metal material and clamped to the inner frame 67 by bolts 69 (see FIG. 17), such integral assembly including a lower peripheral side wall 18 of the gas chamber, a non-circular concave portion 20, an outer contour 28 and a circular plane portion 21. A heat-insulating space 70 is formed between the walls 18, 20, 28 and 21 and the inner frame 67 and an air cooling space 71 is formed between the frame 67 and the frame 68.

Positioning pins 72 are planted on the outer frame 68 and they are engaged with holes 73 formed on the seat member 111. When the lower end of the inner frame 67 is gas-tightly placed on the top face of the seat member 111, the ring member 112 is positioned on the seat member 111 and they are supported so that they cannot be rotated relatively to each other. Openings 74 for introducing cooling air to the space 71 are formed on the seat member 111.

A trivet member 15 supporting the bottom of a pan is fixed to a ring-like receiving stand 75 for receiving any overflowing food and for intercepting radiated heat. This trivet member 15 is disposed so that it is rotatable relatively to the upper member 12 but not rotatable relatively to the ring member 112. In this embodiment, the upper member 12 comprises rotation handles 17 and bosses 76 capable of sliding relatively to the receiving stand 75 under loads of the trivet member 15 and the receiving stand 75. The upper member 12 further includes rods 77 of which the rotation range is limited by impingement on the outer frame 68 of the ring member. The outer frame 68 has projections 78 including stoppers 32 limiting the rotation range of the rods 77. Positioning pins 79 are planted on these projections 78 and holes 80 are formed on the receiving stand 75. When the pins 79 are engaged with these holes 80, the trivet member 15 is positioned and fixed onto the ring member 112 so that it cannot be rotated.

In this embodiment, the clearance 47 between the lower peripheral side wall 52 of the fuel chamber and the inner face of the lower peripheral side wall 18 is further narrowed, and the heat is transferred more effectively from the side wall 18 to the peripheral wall 4 of the fuel chamber. Further, since the annular air passage 39 is formed in a position very close to the fuel gas openings 5, the maximum heating power can be further enhanced and the time lag in the heating power adjustment can be further shortened while the effect of preventing undulation and intermission of flames can be further enhanced.

Figure 18:
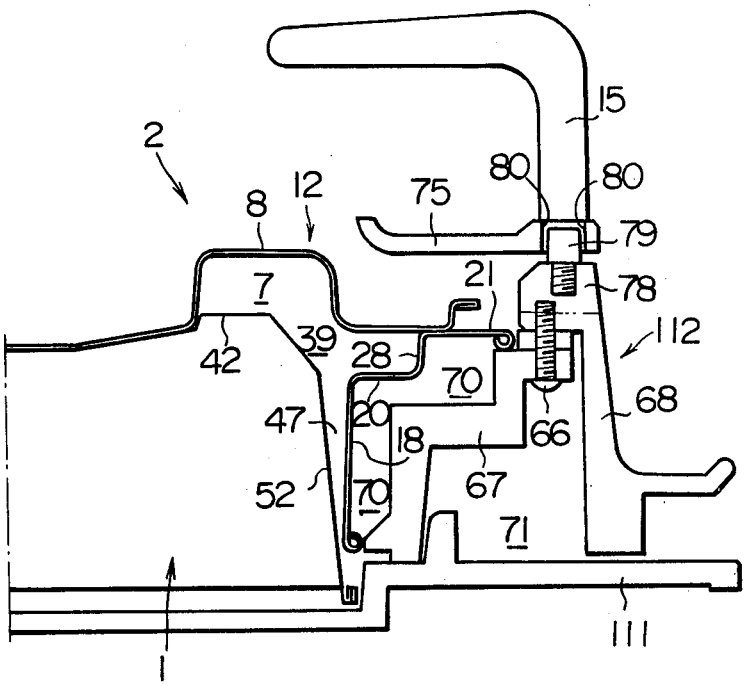
FIG. 18 is a partial section taken along the line XVIII—XVIII in FIG. 16.
Figure 19:
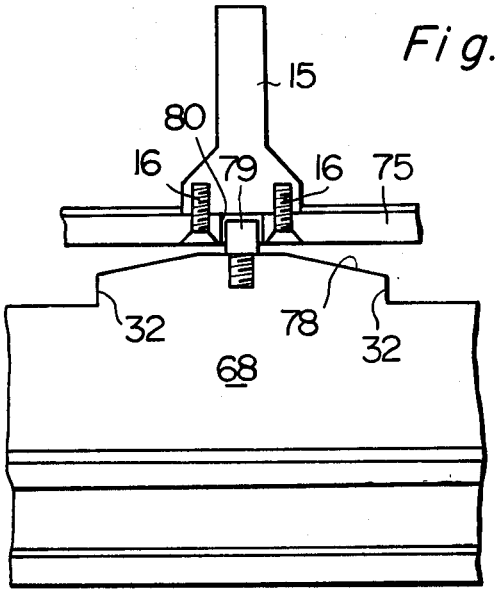
FIG. 19 is an elevational view showing the engagement between a trivet and a ring member in the embodiment shown in FIG. 18.
Figure 20:
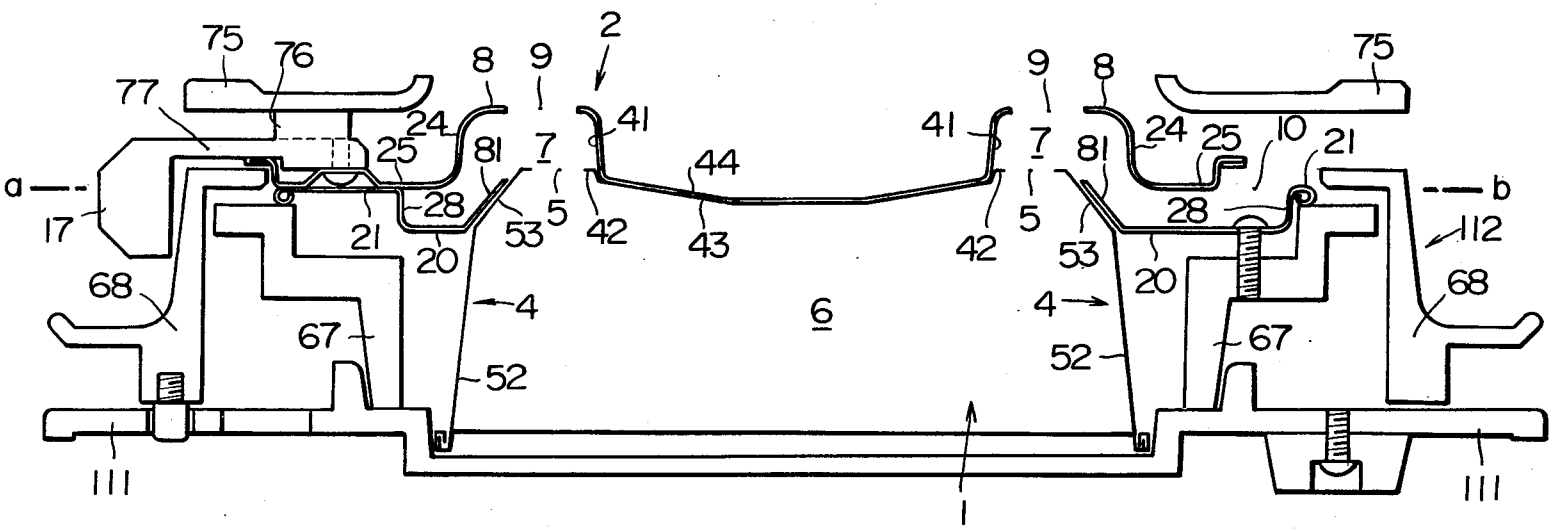
FIG. 20 is a sectional side view illustrating still another embodiment of the burner of the present invention.

In the embodiment shown in FIGS. 17 to 19, the inner end of the non-circular concave portion 20 of the ring member 112 is extended as the lower peripheral side wall 18 of the gas chamber. However, it is possible to adopt instead of the arrangement shown in FIGS. 17 to 19 an arrangement in which, as shown in FIG. 20, the inner end of the non-circular concave portion 20 is extended in the horizontal direction to an upwardly inclined tapered portion 81 which is formed so that the tapered portion 81 is close to the upper peripheral side wall 53 of the fuel chamber. Also in this embodiment, the same effects as attained in the foregoing embodiment shown in FIGS. 17 to 19 can be similarly attained.

As will be apparent from the foregoing illustration, in the burner of the present invention, the heating power can be adjusted by many stages through a broad range by a simple operation of adjusting the degree of opening of air openings. Furthermore, incomplete combustion can be effectively prevented and the maximum heating power can be enhanced to a level much higher than in the conventional burners. Still further, the maximum heating power can be uniformalized in any stage during the period ranging from a point just after ignition to a point just before exhaustion of the fuel. In addition, the time lag in the heating power adjustment can be made much shorter than in the conventional burners, and undulation and intermission of flames can be effectively prevented in any stage of the heating power adjustment.

Incidentally, in the burner of the present invention, the ignition operation can easily be accomplished in the following manner:

A sealing lid 82 sealing the upper portions of the final gas openings 9 is dismounted from the burner proper 2, and the holding piece 17 is turned so that the variable air openings 10 are most opened (the state shown in FIG. 2 or 5). Then, an ignition source such as a lighted match is inserted into the gas chamber 7 through one final gas opening 9 to ignite a fuel gas flown out from the inner space 6 of the fuel chamber 1 through the fuel gas opening 5 and being present in a space above the fuel gas openings 5 in the gas chamber 7, whereby the ignition operation can easily be accomplished.

The extinguishing operation can easily be accomplished in the following manner:

The handling piece 17 is turned so as to completely close the variable air openings 10 (the state shown in FIG. 4-B) and weaken the heating power. Then, the sealing lid 82 is placed above the final gas openings 9 to seal the openings 9, whereby the extinguishing operation can easily be accomplished. Typical instances of the structure of the sealing lid 82 are illustrated in FIGS. 2 and 5. Instead of these structures, there may be adopted other structures so far as the above sealing effect can be attained. For example, a sealing lid having openings arranged in the same manner as the final gas openings 9 may be adopted. In this case, the final gas openings 9 are opened or closed by overlapping or non-overlapping of such sealing openings on the final gas openings 9. The sealing lid having such openings may be attached to the ceiling wall 8 of the gas chamber of the burner proper 2 or some other part so that it can slide relatively to the inner or outer face of the ceiling wall 8 of the gas chamber on which the final gas openings 9 are formed.

What is claimed is:

1. A burner of the air adjustment type using a liquid fuel, said burner comprising:

a fuel chamber including a ceiling wall, a bottom wall, a peripheral side wall, and a plurality of fuel gas openings distributed and arranged annularly on an outer edge portion of said ceiling wall;

a burner proper including a fuel chamber attachment, an inner gas chamber including a peripheral side wall and a ceiling wall, a plurality of final gas openings arranged and annularly distributed in said ceiling wall of said gas chamber, and variable air openings connected to said gas chamber;

an annular variable air passage surrounding said fuel chamber and being connected to said variable air openings at a position lower than the position of said fuel gas openings, said annular variable air passage being formed between an inner face of said peripheral side wall of said gas chamber of said burner proper and an outer face of said peripheral side wall of said fuel chamber;

said fuel gas openings, said final gas openings and said annular variable air passage being arranged in such a positional relationship that when said variable air openings are opened, a variable combustion layer is formed in said gas chamber between a fuel gas stream extended from said fuel gas openings to said final gas openings and a variable air stream on the periphery of said fuel gas stream and connected to said variable air openings;

a cylindrical or tapered central inner wall extending between the vicinity of inner end edges of said final gas openings on said ceiling wall of said gas chamber and the vicinity of said fuel gas openings, the innermost face of said gas chamber being defined by said cylindrical or tapered central inner wall, said cylindrical or tapered central inner wall and said ceiling wall of said fuel chamber being disposed so that heat can be transferred between said cylindrical or tapered central inner wall and said ceiling wall of said fuel chamber through the central portion of said ceiling wall of said fuel chamber, said central portion being surrounded by said annularly arranged and distributed fuel gas openings;

a central bottom wall projecting downwardly through said cylindrical or tapered central inner wall, said central bottom wall and said cylindrical or tapered central inner wall being integrally mounted with said ceiling wall of said gas chamber; and said central bottom wall being thermo-conductively connected to said central portion of said ceiling wall of said fuel chamber.

2. A burner as set forth in claim 1, wherein at least said ceiling wall of the fuel chamber is composed of a thin metal material, a liquid fuel held in a liquidabsorbing elastic substance is contained in the interior of the fuel chamber, and the inner face of the central bottom wall of the ceiling wall of the gas chamber is elastically contacted and engaged with the central portion of the ceiling wall of the fuel chamber.

3. A burner as set forth in claim 1, wherein the cylindrical or tapered central inner wall includes a substantially horizontal bottom wall end edge portion connected to the lower end edge thereof and partially covering the upper portion of said fuel gas openings, and an annular communication groove having a small size in the vertical direction is formed between the inner face of said bottom wall end edge portion and the fuel gas opening.

4. A burner as set forth in claim 1, wherein the ceiling wall of said gas chamber has in its central portion surrounded by the final gas openings a cylindrical or tapered central outer wall located outwardly of the gas chamber, an outer central bottom wall projected downwardly through said cylindrical or tapered central outer wall, a thin cylindrical or tapered central inner wall located inwardly of the gas chamber and an inner central bottom wall projected downwardly through said central inner wall, and a heat-insulating space is formed between said cylindrical or tapered central outer wall and said central inner wall.

5. A burner as set forth in claim 1, wherein said ceiling wall of said gas chamber is composed of a metal having a relatively low heat conductivity and at least said ceiling wall in the fuel chamber is composed of a metal having a relatively high heat conductivity.

6. A burner of the air adjustment type using a liquid fuel, said burner comprising:

a fuel chamber including a ceiling wall, a bottom wall, a peripheral side wall, and a plurality of fuel gas openings distributed and arranged annularly on an outer edge portion of said ceiling wall;

a burner proper including a fuel chamber attachment, an inner gas chamber including a peripheral side wall and a ceiling wall, a plurality of final gas openings arranged and annularly distributed in said ceiling wall of said gas chamber, and variable air openings connected to said gas chamber;

an annular variable air passage surrounding said fuel chamber and being connected to said variable air openings at a position lower than the position of said fuel gas openings, said annular variable air passage being formed between an inner face of said peripheral side wall of said gas chamber of said burner proper and an outer face of said peripheral side wall of said fuel chamber;

said fuel gas openings, said final gas openings and said annular variable air passage being arranged in such a positional relationship that when said variable air openings are opened, a variable combustion layer is formed in said gas chamber between a fuel gas stream extended from said fuel gas openings to said final gas openings and a variable air stream on the periphery of said fuel gas stream and connected to said variable air openings;

a cylindrical or tapered central inner wall extending between the vicinity of inner end edges of said final gas openings on said ceiling wall of said gas chamber and the vicinity of said fuel gas openings, the innermost face of said gas chamber being defined by said cylindrical or tapered central inner wall, said cylindrical or tapered central inner wall and said ceiling wall of said fuel chamber being disposed so that heat can be transferred between said cylindrical or tapered central inner wall and said ceiling wall of said fuel chamber through the central portion of said ceiling wall of said fuel chamber, said central portion being surrounded by said annularly arranged and distributed fuel gas openings; and said cylindrical or tapered central inner wall being integrally mounted with said ceiling wall of said fuel chamber in the vicinity of the inner end edges of said fuel gas openings.

7. A burner of the air adjustment type using a liquid fuel, said burner comprising:

a fuel chamber including a top surface portion, a bottom wall, a peripheral side wall, and at least one fuel gas opening in said top surface portion;

a burner proper including a fuel chamber attachment, an inner gas chamber including a peripheral side wall and a ceiling wall, a plurality of final gas openings arranged and annularly distributed in said ceiling wall of said gas chamber, and variable air openings connected to said gas chamber;

an annular variable air passage surrounding said fuel chamber and being connected to said variable air openings at a position lower than the position of said fuel gas opening, said annular variable air passage being formed between an inner face of said peripheral side wall of said gas chamber of said burner proper and an outer face of said peripheral side wall of said fuel chamber;

said fuel gas opening, said final gas openings and said annular variable air passage being arranged in such a positional relationship that when said variable air openings are opened, a variable combustion layer is formed in said gas chamber between a fuel gas stream extended from said fuel gas opening to said final gas openings and a variable air stream on the periphery of said fuel gas stream connected to said variable air openings;

a cylindrical or tapered central inner wall extending between the vicinity of inner end edges of said final gas openings on said ceiling wall of said gas chamber and the vicinity of said fuel gas opening, the innermost face of said gas chamber being defined by said cylindrical or tapered central inner wall; and said cylindrical or tapered central inner wall and a central bottom wall projected downwardly through said cylindrical or tapered central inner wall being integrally mounted with said ceiling wall of said gas chamber.

8. A burner as set forth in claim 7, wherein the ceiling wall of said gas chamber has a downwardly indented concave portion on the surface of the central portion thereof surrounded by the final gas openings.

9. A burner of the air adjustment type using a liquid fuel, said burner comprising:

a fuel chamber including a top surface portion, a bottom wall, a peripheral side wall and at least one fuel gas opening in said top surface portion;

a burner proper including a fuel chamber attachment, an inner gas chamber including a peripheral side wall and a ceiling wall, a plurality of final gas openings arranged and annularly distributed in said ceiling wall of said gas chamber, and variable air openings connected to said gas chamber;

an annular variable air passage surrounding said fuel chamber and being connected to said variable air openings at a position lower than the position of said fuel gas opening, said annular variable air passage being formed between an inner face of said peripheral side wall of said gas chamber of said burner proper and an outer face of said peripheral side wall of said fuel chamber, said annular variable air passage extending substantially in the vertical direction, and the sectional area of said annular variable air passage in the horizontal direction gradually increasing upwardly; and said fuel gas opening, said final gas openings and said annular variable air passage being arranged in such a positional relationship that when said variable air openings are opened, a variable combustion layer is formed in said gas chamber between a fuel gas stream extended from said fuel gas opening to said final gas openings and a variable air stream on the periphery of said fuel gas stream connected to said variable air openings.

10. A burner as set forth in claim 9, wherein the inner face of the peripheral side wall of said gas chamber is substantially vertical and the outer face of the peripheral side wall of the fuel chamber has an inclined face expanded downwardly in the vertical direction.

11. A burner as set forth in claim 9, wherein the outer face of the peripheral side wall of said fuel chamber and the inner face of the peripheral side wall of said gas chamber are extended downwardly beyond the variable air openings opened to said annular variable air passage or a communication opening to said variable air openings, and the clearance between the outer face of the peripheral side wall of said fuel chamber and the inner face of the peripheral side wall of said gas chamber is narrowed in a region below the variable air openings or the communication opening to the variable air openings.

12. A burner of the air adjustment type using a liquid fuel, said burner comprising:

a fuel chamber including a top surface portion, a bottom wall, a peripheral side wall and at least one fuel gas opening in said top surface portion;

a burner proper including a fuel chamber attachment, an inner gas chamber including a peripheral side wall and a ceiling wall, a plurality of final gas openings arranged and annularly distributed in said ceiling wall of said gas chamber, and variable air openings connected to said gas chamber;

an annular variable air passage surrounding said fuel chamber and being connected to said variable air openings at a position lower than the position of said fuel gas opening, said annular variable air passage being formed between an inner face of said peripheral side wall of said gas chamber of said burner proper and an outer face of said peripheral side wall of said fuel chamber;

said fuel gas opening, said final gas openings and said annular variable air passage being arranged in such a positional relationship that when said variable air openings are opened, a variable combustion layer is formed in said gas chamber between a fuel gas stream extended from said fuel gas opening to said final gas openings and a variable air stream on the periphery of said fuel gas stream connected to said variable air openings;

said burner proper having a pair of outer wall members, each said outer wall member including a cylindrical or tapered outer side wall having an opening connected to said annular variable air passage, said two outer wall members having outer side walls which are slidable relative to each other;

the said opening of a first of said outer side walls having upper and lower end edges, said lower end edge being inclined at an angle larger than that of said upper end edge, the vertical distance between said upper end edge and said lower end edge gradually changing from a maximum to a minimum;

the said opening of a second of said outer side walls comprising a vertically elongated opening having a vertical size sufficient to cover said upper end edge and said lower end edge of the first-mentioned opening of said first outer side wall; and the open area of said variable air openings being adjusted by changing the area of overlap between the first-mentioned opening and the second-mentioned, elongated opening.

13. A burner of the air adjustment type using a liquid fuel, said burner comprising:

a fuel chamber including a top surface portion, a bottom wall, a peripheral side wall and at least one fuel gas opening in said top surface portion;

a burner proper including a fuel chamber attachment, an inner gas chamber including a peripheral side wall and a ceiling wall, a plurality of final gas openings arranged and annularly distributed in said ceiling wall of said gas chamber, and varaible air openings connected to said gas chamber;

an annular variable air passage surrounding said fuel chamber and being connected to said variable air openings at a position lower than the position of said fuel gas opening, said annular variable air passage being formed between an inner face of said peripheral side wall of said gas chamber of said burner proper and an outer face of said peripheral side wall of said fuel chamber;

said fuel gas opening, said final gas openings and said annular variable air passage being arranged in such a positional relationship that when said variable air openings are opened, a variable combustion layer is formed in said gas chamber between a fuel gas stream extended from said fuel gas opening to said final gas openings and a variable air stream on the periphery of said fuel gas stream connected to said variable air openings;

said burner proper further including a lower member supporting said fuel chamber and an upper member including said ceiling wall of said gas chamber, said upper member and said lower member being disposed so that they are rotatable relative to each other along respective horizontal sliding faces thereof;

said sliding face of one of said upper and lower members comprising a plane face having a non-circular projected shape, and said sliding face of the other of said upper and lower members comprising a plane having a circular outer contour having on the periphery thereof a circumferential outer step shoulder, the inside of said outer step shoulder being engageable with the outer end side face of said non-circular projected plane face, so that relative rotation is possible between said two sliding faces by relative sliding movement of said upper and lower members;

a non-circular concave portion being formed in the interior of said circular plane face, with a clearance between said non-circular projected plane and said concave portion, said concave portion having a non-circular outer contour of a size to be completely covered by said non-circular projected plane;

said variable air openings being formed between the outer end of said non-circular projected plane and the outer contour of said non-circular concave portion located outwardly of said outer end of said non-circular projected plane, so that the relative open area of the variable air openings are changeable through a range inclusive of a completely closed state by relative sliding movement of said circular plane and said non-circular projected plane; and said non-circular concave portion and said non-circular projected plane having therebetween a space which forms a communication passage, an outer end portion of said communication passage being connected to said variable air openings, and an inner end portion of said communication passage being annularly opened to said gas chamber.

14. A burner as set forth in claim 13, wherein said upper member and said lower member are disposed so that they can be dismounted and separated from each other.

15. A burner as set forth in claim 14, wherein said fuel chamber is disposed so that it can be dismounted and separated from said lower member.

16. A burner as set forth in claim 13, wherein said lower member comprises a seat member supporting said fuel member and a ring member surrounding a lower portion of said peripheral side wall of said fuel chamber and supporting said upper member, and said seat member and said ring member are disposed so that they can be dismounted and separated from each other.

17. A burner as set forth in claim 16, wherein said fuel chamber and said ring member are disposed in such a positional relationship that after said ring member has been removed from said seat member, the fuel chamber can be dismounted and separated from the seat member.

18. A burner as set forth in claim 16, wherein means for positioning said fuel chamber and means for positioning said ring member are mounted on said seat member.

19. A burner as set forth in claim 16, wherein said ring member and said seat member having portions to be engaged with each other so that relative rotation therebetween is prevented when they are assembled.

20. A burner as set forth in claim 16, wherein a trivet member for supporting the bottom of a pan is relatively rotatably supported on the upper member, said trivet member being prevented from relative rotation with respect to said ring member.

21. A burner as set forth in claim 20, wherein said ring member has a projection in an upper portion thereof, said trivet member has a concave part in a lower portion thereof, and said ring member and said trivet member are disposed so that by engagement of said projection with said concave part said ring member and said trivet member are not allowed to rotate relative to each other.

22. A burner of the air adjustment type using a liquid fuel, said burner comprising:

a fuel chamber including a top surface portion, a bottom wall having an outer peripheral edge portion, a peripheral side wall having a lower end portion connected in a liquid and gas tight manner to said outer peripheral edge portion of said bottom wall, and at least one fuel gas opening in said top surface portion;

a burner proper including a gas chamber having a ceiling wall having an outer peripheral edge portion, an outer peripheral side wall having an upper end portion connecting in a gas tight manner to said outer peripheral edge portion of said ceiling wall, a bottom portion including fuel chamber attachment means for closing in a liquid and gas tight manner the bottom portion of said gas chamber, a plurality of final gas openings arranged and annularly distributed in said ceiling wall of said gas chamber, and variable air openings connected to said gas chamber;

said fuel gas opening of said fuel chamber opening upwardly into the interior of said gas chamber at a position lower than the position of said final gas openings of said gas chamber;

an annular variable air passage surrounding said fuel chamber and being connected to said variable air openings at a position lower than the position of said fuel gas opening, said annular variable air passage being formed between an inner face of said outer peripheral side wall of said gas chamber of said burner proper and an outer face of said peripheral side wall of said fuel chamber; and said fuel gas opening, said final gas openings, said variable air openings and said annular variable air passage being arranged in such a positional relationship that when said variable air openings are opened, an annular variable combustion layer is annularly formed between a fuel gas stream extended upwardly from said fuel gas opening to said final gas openings and an annular variable air stream connected to said variable air openings and flowing annularly and upwardly through said annular variable air passage and surrounding the outer periphery of said fuel gas stream.

23. A burner as set forth in claim 22, wherein a heat-insulating space is formed between said bottom wall of said fuel chamber and said burner proper.

24. A burner as set forth in claim 22, further comprising a cylindrical or tapered central inner wall extending between the vicinity of inner end edges of said final gas openings on said ceiling wall of said gas chamber and the vicinity of said fuel gas opening, said cylindrical or tapered central inner wall being slightly inwardly spaced from said outer peripheral side wall of said gas chamber to therewith form an annular space for three streams of fuel gas, variable combustion layer and variable air, and an innermost side face of an upper portion of said gas chamber, inwardly of the position of said fuel gas opening of said fuel chamber, being defined by said cylindrical or tapered central inner wall.

25. A burner as set forth in claim 24, wherein said fuel chamber further includes a ceiling wall having an outer edge portion connected in a gas tight and heat conductive manner to an upper end portion of said peripheral side wall of said fuel chamber, and a plurality of fuel gas openings arranged and annularly distributed in said outer edge portion of said ceiling wall of said fuel chamber, and wherein said cylindrical or tapered central inner wall and said ceiling wall of said fuel chamber are disposed so that heat can be transferred between said cylindrical or tapered central inner wall and said ceiling wall of said fuel chamber through a central portion of said ceiling wall of said fuel chamber, said central portion being surrounded by said annularly arranged and distributed fuel gas openings.

* * * * *